US007204278B2

(12) United States Patent
Koyanagi et al.

(10) Patent No.: US 7,204,278 B2
(45) **Date of Patent: *Apr. 17, 2007**

(54) STRUCTURE OF CHECK-VALVE AND PRODUCTION METHOD THEREOF AND INFLATABLE AIR-PACKING DEVICE USING SAME

(75) Inventors: Hidetoshi Koyanagi, Kashiwara (JP); Yasuzumi Tanaka, Kawasaki (JP); Katsutoshi Yoshifusa, Lake Forest, CA (US)

(73) Assignee: Air-Paq, Inc. CA (US)

( * ) Notice: Subject to any disclaimer, the term of this patent is extended or adjusted under 35 U.S.C. 154(b) by 277 days.

This patent is subject to a terminal disclaimer.

(21) Appl. No.: 10/854,656

(22) Filed: May 26, 2004

(65) Prior Publication Data

US 2005/0263205 A1 Dec. 1, 2005

(51) Int. Cl.
*B65B 3/16* (2006.01)

(52) U.S. Cl. ..... 141/114; 141/10; 141/313; 141/317; 53/467; 53/469

(58) Field of Classification Search ..... 141/2, 141/10, 18, 67, 68, 114, 234–238, 286, 313, 141/317, 82; 206/522; 53/559, 567, 568, 53/457, 459, 467, 469, 570

See application file for complete search history.

(56) References Cited

U.S. PATENT DOCUMENTS 5,261,466 A * 11/1993 Koyanagi ..... 141/10
5,826,723 A 10/1998 Jaszai
5,857,571 A 1/1999 Tschantz
5,901,850 A 5/1999 Jones et al.
5,996,798 A 12/1999 Gessert
6,076,677 A 6/2000 Pozzo
6,464,079 B1 10/2002 Newman
6,629,777 B2 10/2003 Tanaka et al.
6,722,502 B1 4/2004 Newman
7,000,767 B2 * 2/2006 Tanaka et al. ..... 206/522

* cited by examiner

*Primary Examiner*—Timothy L. Maust
(74) *Attorney, Agent, or Firm*—Muramatsu & Associates

(57) ABSTRACT

A check valve for use in an air-packing device has a simple structure and promotes to easily inflate all of the air cells of the air-packing device with a relatively lower pressure. The check valves can be easily attached to any locations of the air-packing device. The check valves are formed when a check valve film is attached to one of the first and second thermoplastic films. Peeling agents of predetermined pattern are applied on the check valve film which prevents heat-sealing between the first and second thermoplastic films for air tightly separating two adjacent air containers. The check valve is configured by an air flow maze portion having a zig-zag air passage and a common air duct portion which provides the air to the air flow maze portion of a current air container as well as to the air flow maze portion of a next air container.

30 Claims, 23 Drawing Sheets

STRUCTURE OF CHECK-VALVE AND PRODUCTION METHOD THEREOF AND INFLATABLE AIR-PACKING DEVICE USING SAME

FIELD OF THE INVENTION

This invention relates to a check valve for an air-packing device which absorbs shocks for protecting a product, and more particularly, to a structure of check valve for use in an air-packing device which has a simple structure and can easily inflate all of the air cells of the air-packing device with a relatively lower pressure of the air, and which can be easily attached to any locations of the air-packing device.

BACKGROUND OF THE INVENTION

In a distribution channel such as product shipping, a styroform packing material has been used for packing commodity and industrial products. Although the styroform package material has a merit such as a good thermal insulation performance and a light weight, it has also various disadvantages: recycling the styroform is not possible, soot is produced when it burns, a flake or chip comes off when it is snagged because of it's brittleness, an expensive mold is needed for its production, and a relatively large warehouse is necessary to store it.

Therefore, to solve such problems noted above, other packing materials and methods have been proposed. One method is a fluid container of sealingly containing a liquid or gas such as air (hereafter "air-packing device"). The air-packing device has excellent characteristics to solve the problems involved in the styroform. First, because the air-packing device is made of only thin sheets of plastic films, it does not need a large warehouse to store it unless the air-packing device is inflated. Second, a mold is not necessary for its production because of its simple structure. Third, the air-packing device does not produce a chip or dust which may have adverse effects on precision products. Also, recyclable materials can be used for the films forming the air-packing device. Further, the air-packing device can be produced with low cost and transported with low cost.

FIG. 1 shows an example of air-packing device in the conventional technology. The air-packing device 10*a* is composed of first and second thermoplastic films 13 and 14, respectively, and a check valve 11. Typically, each thermoplastic film is composed of three layers of materials: polyethylene, nylon and polyethylene which are bonded together with appropriate adhesive. The first and second thermoplastic films 13 and 14 are heat-sealed together around rectangular seal portions 12*a*, 12*b* to air-tightly close after the check valve 11 is attached. Thus, one air-packing device 10*a* sealed with the heat seal portions 12*a*, 12*b* is formed as shown in FIG. 1.

FIGS. 2A–2B show another example of an air-packing device 10*b* with multiple air containers where each air container is provided with a check valve. A main purpose of having multiple air containers is to increase the reliability. Namely, even if one of the air containers suffers from an air leakage for some reason, the air-packing device can still function as a cushion or shock absorber for protecting a product because other air containers are intact.

With reference to FIG. 2A, this fluid container 10*b* is made of the first and second thermoplastic films which are bonded together around a rectangular periphery 23*a* and further bonded together at each boundary of two air containers 22 so that a guide passage 21 and air containers 22 are created. When the first and second thermoplastic container films are bonded together, as shown in FIG. 2A, the check valves 11 are also attached to each inlet port of the air container 22. By attaching the check valves 11, each air container 22 becomes independent from the other. The inlet port 24 of the air-packing device lob is used when filling a fluid (typically air) to each air container 22 by using, for example, an air compressor.

FIG. 2B shows the air-packing device 10*b* of FIG. 2A when inflated with the air. First, each air container 22 is filled with the air from the inlet port 24 through the guide passage 21 and the check valve 11. To avoid a rupture of the air containers by variations in the environmental temperature, the air into the container is typically stopped when the air container 22 is inflated at about 90% of its full expansion rate. After filling the air, the expansion of each air container is maintained because each check-valve 11 prevents the reverse flow of the air. Typically, an air compressor has a gauge to monitor the supplied air pressure, and automatically stops supplying the air to the air-packing device 10*b* when the pressure reaches a predetermined value.

The check valve 11 is typically made of two rectangular thermoplastic valve films which are bonded together to form a fluid pipe. The fluid pipe has a tip opening and a valve body to allow a fluid flowing through the fluid pipe from the tip opening but the valve body prevents the reverse flow. Examples of structure of check-valve are described in more detail in the U.S. Pat. Nos. 5,209,264, 5,927,336 and 6,629,777. This check valve is attached to the thermoplastic films of the air packing device during or after the manufacturing process of the air-packing device.

As shown in FIGS. 2C–2E, the conventional check valves have problems. For example, when the air-packing device 10*b* is inflated, both sides 23*a* and 23*b* of the check valve body is pressed inwardly by the expansion of the air container 22. The directions of the pressing force is shown by arrows 25 in FIG. 2C. As a result, the check valves 11 become wavy such as shown in FIG. 2D although the bonded portion was straight before the air-packing device 10*b* is inflated.

As mentioned above, the check valve 11 is typically made of two thermoplastic films. By the pressure noted above, sometimes, a gap is created between the thermoplastic films 11*a* and the check-valve 11 of the air container 22. Thus, the air is leaked through the gap as shown in FIG. 2E where the leakage in the check valve 11*a* is shown by an arrow 27. In other words, the reverse flow in the air container by the check valve 11*a* occurs and the air from the air container 22 flows into the guide passage 21 in this example.

When using the check valves describe above, the pressure required to fill the fluid container can be large because when the air container is long and the guide passage 21 is narrow. This is especially true when each air container is configured by a plurality of air cells connected in series because the air has to be supplied from one end to another end of the air-packing device through many air cells. This can be a problem when the air compressor does not have much power to supply air with high pressure, or the part of the air-packing device closer to the air input may be damaged.

Still other problem with regard to the air-packing device having the conventional check valves described above lies in the inflexibility in mounting the check valve. As shown in FIGS. 2A–2B, the check valves 11 must be positioned adjacent to the guide passage 21, i.e. the air inlet port 24. Because the guide passage 21 must be positioned at the very end of the air-packing device 10*b*, freedom of designing the shape of the air-packing devices is severely limited.

As described in the foregoing, the air-packing device using the check valves is highly useful for packing commodity products and industrial products instead of the styroform packing. However, the conventional check valves have the problems as described above. Thus, there is a strong need for a check valve that can solve the above noted problems and an air-packing device implementing the new check valves.

SUMMARY OF THE INVENTION

It is, therefore, an object of the present invention to provide a new structure of a check valve for an air-packing device that can be produced with low cost and easily attached to the air-packing device.

It is another object of the present invention to provide a new structure of a check valve for an air-packing device that can be attached to any positions of the air-packing device.

It is a further object of the present invention is to provide a structure of a check valve which is configured by a single film attached to a thermoplastic film of the air-packing device.

It is a further object of the present invention is to provide a structure of a check valve which is configured by two films juxtaposed with one another and attached to a thermoplastic film of the air-packing device.

It is a further object of the present invention is to provide a structure of a check valve for use with an air-packing device wherein peeling agents are printed on predetermined locations on the check valve film.

It is a further object of the present invention is to provide various forms of air-packing device having the check valves of the invention where the air-packing device of a sheet form is folded and post heat-sealing is applied thereto to form a unique three dimensional shape for packing a product to be protected.

One aspect of the present invention is a structure of check valves for use in an air-packing device for protecting a product therein wherein the air-packing device has a plurality of air containers and is made of first and second thermoplastic films. The structure of check valve is configured by: a check valve film on which peeling agents of predetermined pattern are printed, the check valve film being attached to one of the first and second thermoplastic films; an air input established by one of the peeling agents on the air-packing device for receiving air from an air source; an air flow maze portion forming an air passage of a zig-zag shape, the air flow maze portion having an exit at an end thereof for supplying the air from the air passage to a corresponding air container having one or more series connected air cells; a common air duct portion which provides the air from the air input to the air flow maze portion of a current air container as well as to the air flow maze portion of a next air container having one or more series connected air cells.

Heat-sealing between the first and second thermoplastic films for air tightly separating two adjacent air containers is prevented in a range where the peeling agent is printed. The air passage in the air flow maze portion is created by heat-sealing the check valve film with one of the first and second thermoplastic films. Double layered check valves can be formed by using an additional film between the check valve film and one of the first and second thermoplastic films.

The check valve film is attached to one of the first and second thermoplastic films at any desired locations of the air-packing device. At least the air passage in the air flow maze portion is closed by air tightly contacting the check valve film with one of the first and second thermoplastic films or the additional film by the air pressure within the air cell when the air-packing device is filled with the compressed air to a sufficient degree.

Preferably, the pattern of the peeling agent on the check valve film has a narrow end and a broad end, and wherein the air input is an opening between the check valve film and one of the first and second thermoplastic films created by the narrow end of the peeling agent. This can be done by forming the pattern of the peeling agent in an L-shape where the narrow end is on a vertical line of the L-shape and the broad end is on a horizontal line of the L-shape. The pattern of the peeling agent on the check valve film can be a belt like shape extending across the sides of the air-packing device.

Another aspect of the present invention is an air-packing device incorporating the above noted check valves for protecting a product therein. The air-packing device is comprised of: first and second thermoplastic films superposed with each other where predetermined portions of the first and second thermoplastic films are bonded, thereby creating a plurality of air containers, each of the air containers having a plurality of series connected air cells; a plurality of check valves established between the first and second thermoplastic films for the corresponding air containers, each of the check valves allowing the compressed air to flow in a predetermined direction of the check valve; an air input formed on one of the check valves to supply the compressed air to all of the series connected air cells through the check valves; and heat-seal flanges that are made of thermoplastic film and are formed on side edges close to both ends of the air-packing device.

In the air-packing device, the check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container. Through a post heat-seal treatment, predetermined points on the air containers are bonded with one another, and the heat-seal flanges are bonded with one another, thereby creating a container portion having an opening for packing a product therein and a cushion portion for supporting the container portion when the air-packing device is inflated by the compressed air.

A further aspect of the present invention is an air-packing device inflatable by compressed air for protecting a product therein. The air-packing device is comprised of: first and second thermoplastic films superposed with each other where predetermined portions of the first and second thermoplastic films are bonded, thereby creating a plurality of air containers of different length, each of the air containers having a plurality of series connected air cells; a plurality of check valves established between the first and second thermoplastic films for the corresponding air containers, each of the check valves allowing the compressed air to flow in a predetermined direction of the check valve; an air input formed on one of the check valves to supply the compressed air to all of the series connected air cells through the check valves; and heat-seal edges made of thermoplastic film and formed on both ends of the air-packing device.

In the air-packing device noted above, the check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container. Through a post heat-seal treatment, predetermined points on the air containers are bonded with one another, and the heat-seal edges are bonded with one another, thereby creating an opening which is larger at a front side than that at a rear side for packing a product therein when the air-packing device is inflated by the compressed air. Due to this structure, when packing a product to be protected in a container box, the opening of the air-packing device packs a corner of the product at each inner corner of the container box thereby securely holding the product in the container box.

A further aspect of the present invention is an air-packing device inflatable by compressed air for protecting a product therein. The air-packing device is comprised of: first and second thermoplastic films superposed with each other where predetermined portions of the first and second thermoplastic films are bonded, thereby creating a plurality of air containers, each of the air containers having one or more series connected air cells; a plurality of check valves established between the first and second thermoplastic films for the corresponding air containers, each of the check valves allowing the compressed air to flow in a predetermined direction of the check valve; an air input formed on one of the check valves to supply the compressed air to all of the air cells through the check valves; and a pair of strings each being formed on an end of the air-packing device.

The product to be protected is wrapped around by the air-packing device and each end of the air-packing device is fastened by the string for securely holding the product therein before or after inflating the air-packing device. The check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container.

A further aspect of the present invention is a method of producing an air-packing device having a plurality of air containers and a plurality of check valves. The method is comprised of the steps of: providing first and second thermoplastic films for forming the plurality of air containers: attaching a check valve film to one of the first and second thermoplastic films, the check valve film being printed thereon predetermined patterns made of peeling agents; forming an air input by one of the peeling agents on the air-packing device for receiving air from an air source; forming an air flow maze portion having an air passage of a zig-zag shape for supplying the air to a corresponding air container having one or more series connected air cells; forming a common air duct portion which provides the air from the air input to the air flow maze portion of a current air container as well as to the air flow maze portion of a next air container having one or more series connected air cells; and bonding the first and second thermoplastic films for air tightly separating the air containers from one another.

The production method further includes a step of folding the air-packing device in a sheet form and heat-sealing predetermined portions to create a container portion having an opening for packing a product to be protected when inflating the air-packing device.

The above noted step of bonding the first and second thermoplastic films for separating the air containers includes a step of preventing the bonding between the first and second thermoplastic films at a range where the peeling agent is printed. Further, the above noted step of forming the air flow maze portion includes a step of bonding the check valve film and one of the first and second thermoplastic films at two or more lines thereby forming the air passage of zig-zag shape.

According to the present invention, the check valves for an air-packing device can be produced with low cost and easily attached to any locations of the air-packing device. The check valve of the present invention allows to flow the air in two opposite directions of the air-packing device. Since the check valves can be attached to any locations on the air-packing device and allows the air flows in two opposite directions of the air-packing device, all of the air cells of the air-packing device can be inflated by air from an air compressor with a lower air pressure.

The check valve can be configured by a single check valve film attached to a thermoplastic film of the air-packing device. Alternatively, the check valve can be configured by two films juxtaposed with one another and attached to a thermoplastic film of the air-packing device. Peeling agents are printed on predetermined locations on the check valve film to produce an air input and a common air duct. Because of this simple structure, the check valves can be made easily with low cost.

BRIEF DESCRIPTION OF THE DRAWINGS

FIG. 3A is a plan view showing a structure of a check valve on an air-packing device, FIG. 3B is a plan view showing the check valve including flows of air indicated by dotted arrows when a compressed air is supplied from an air input, FIG. 3C is a plan view showing the heat-seal portions for bonding the check valve sheet to one of plastic films of the air-packing device, and FIG. 3D is a plan view showing the heat-seal portions for bonding the check valve sheet and the two plastic films of the air-packing device.

FIG. 11A shows the process in which the air-packing device is folded and heat-sealed at the triangle portion and FIG. 11B shows the process in which the air-packing device is heat-sealed at both sides and the air is supplied for inflating the air-packing device.

FIG. 13A is a side view of the air-packing device, and FIG. 13B is a cross sectional side view showing a container box using a pair of air-packing devices of the present invention.

FIG. 18A is a plan view showing the air-packing device in a sheet form, and FIG. 18B is a front view showing the manner of wrapping the product by the air-packing device.

FIG. 19A is a plan view when the air-packing device is in the sheet form, FIG. 19B is a plan view when the air-packing device is inflated, and FIG. 19C is a side view of the air-packing device when inflated.

FIG. 20A is a plan view when the air-packing device is in the sheet form, FIG. 20B is a plan view when the air-packing device is inflated, and FIG. 20C is a side view of the air-packing device when inflated.

DETAILED DESCRIPTION OF THE INVENTION

The present invention provides a new structure of check valve for use in an air-packing device that can reliably prevent reverse flows of the air. The check valve has a simple structure and can be attached at any locations of the air-packing device. Further, the check valve in the present invention can be easily manufactured without major changes of an existing manufacturing apparatus.

Typically, the air-packing device incorporating the check valves of the present invention is folded and bonded at predetermined locations to create a unique three dimensional shape to effectively pack the product to be protected. It should be noted that although the present invention is described for the case of using air for inflating the air-packing device for an illustration purpose, other fluids such as other types of gas or liquid can also be used. The air-packing device is typically used in a container box to pack a product during the distribution flow of the product.

Figure 1:
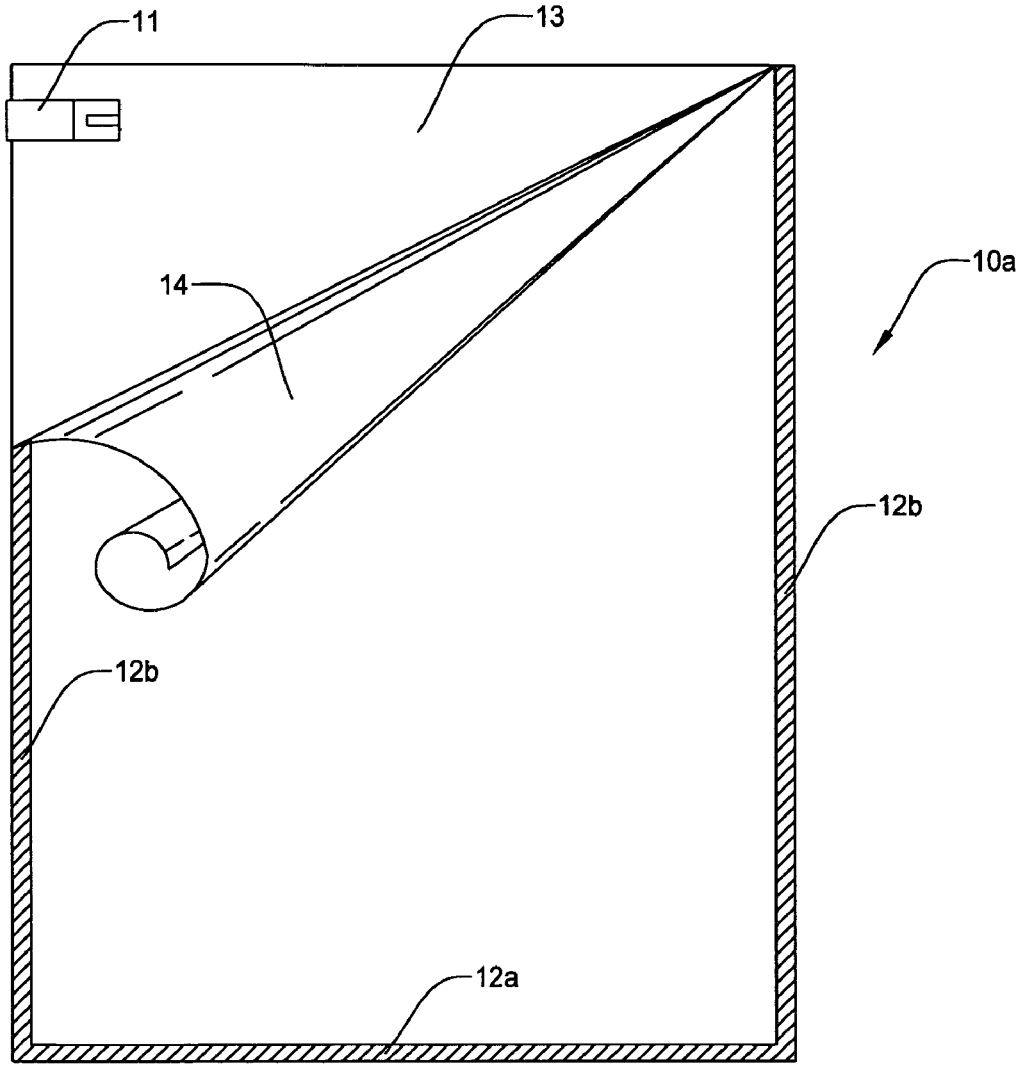
Fig. 1 (Prior Art)
FIG. 1 is a schematic diagram showing an example of structure of an air-packing device with a single air container in the conventional technology.
Figure 2A:
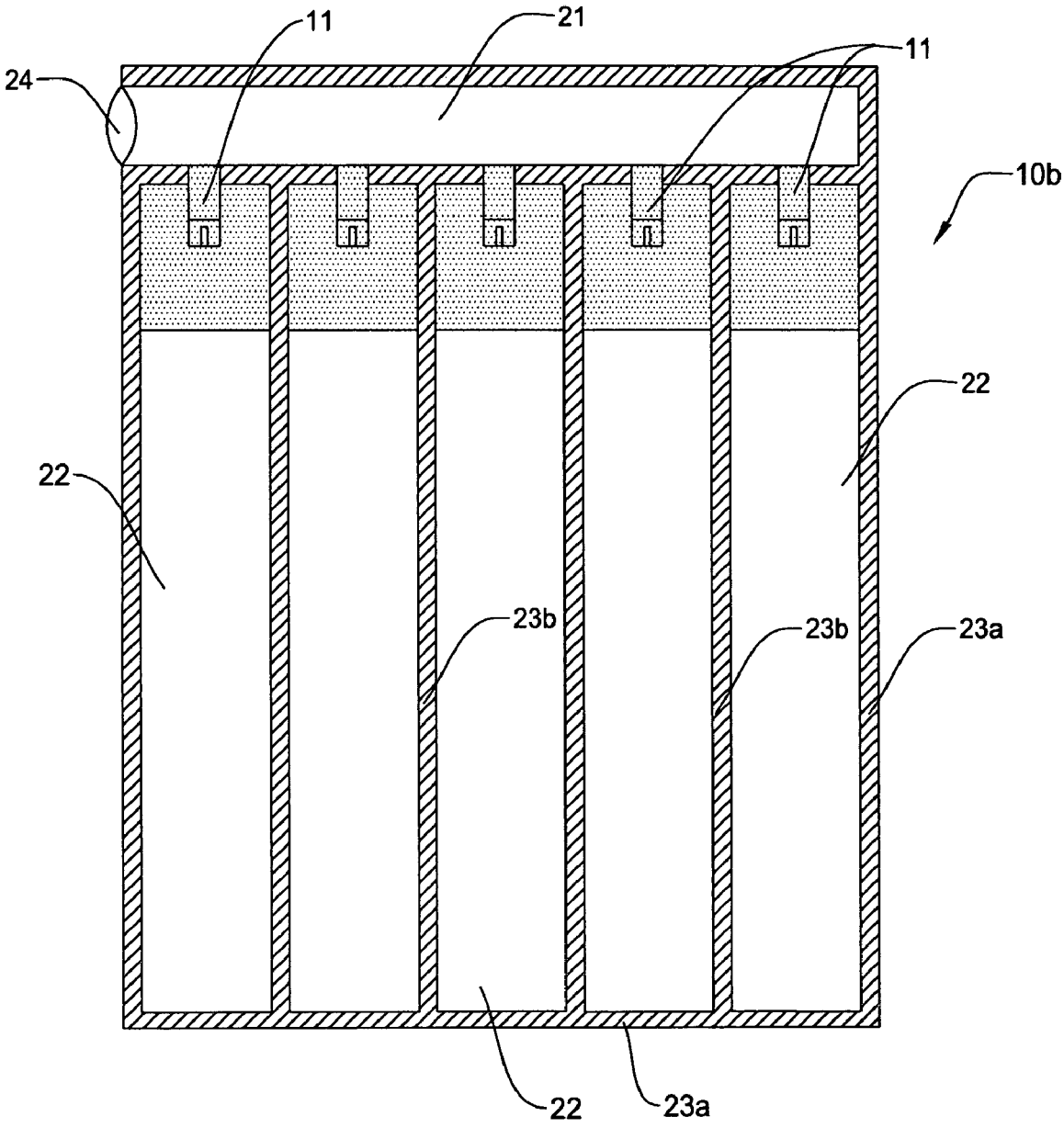
Fig. 2A (Prior Art)
FIGS. 2A–2E are schematic diagrams showing an example of structure of an air-packing device having a plurality of air cells and corresponding check valves in the conventional technology.
Figure 2B:
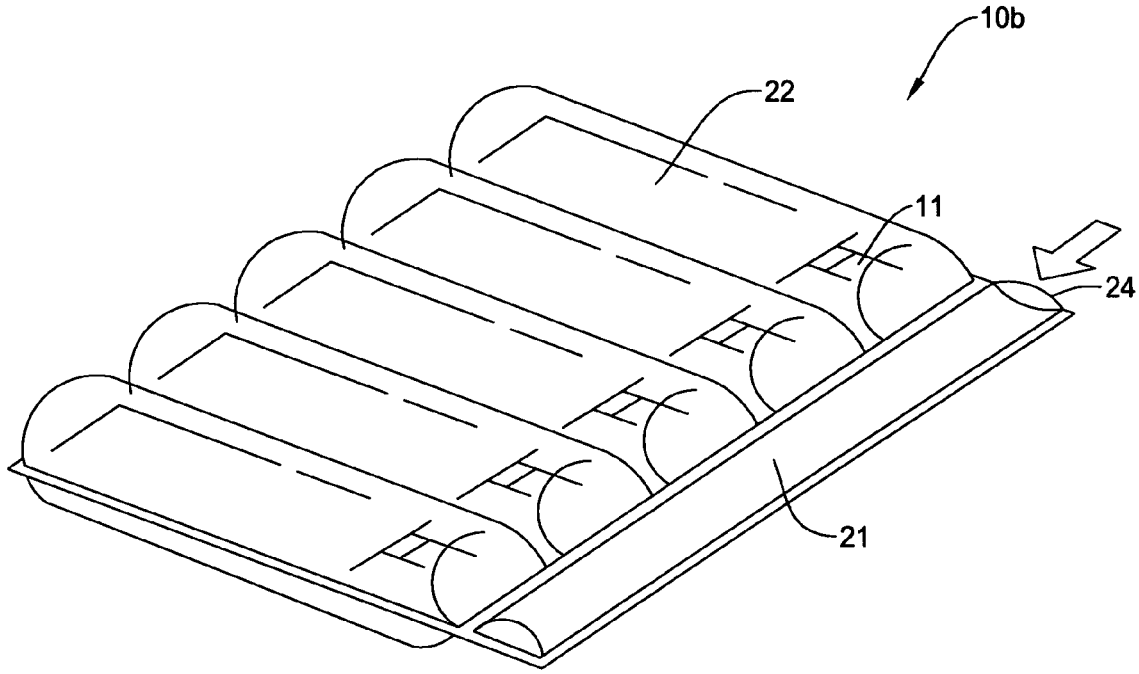
Fig. 2B (Prior Art)
Figure 2C:
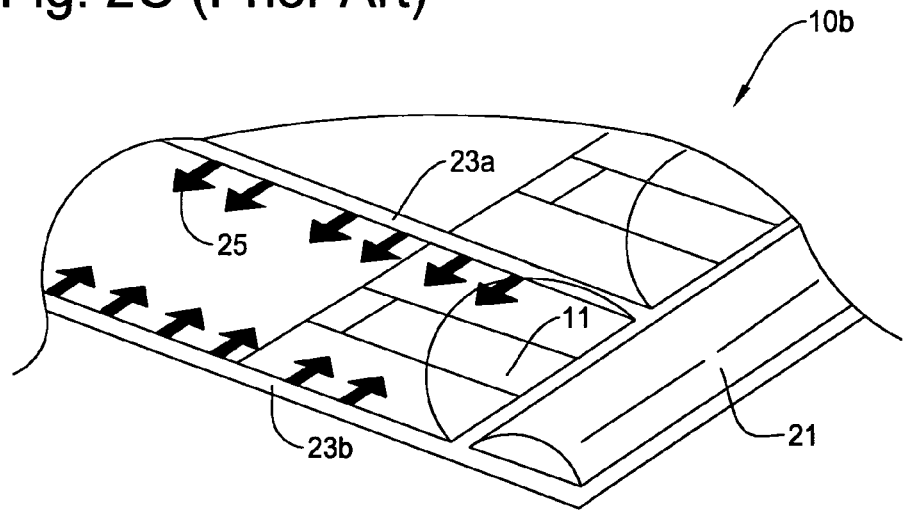
Fig. 2C (Prior Art)
Figure 2D:
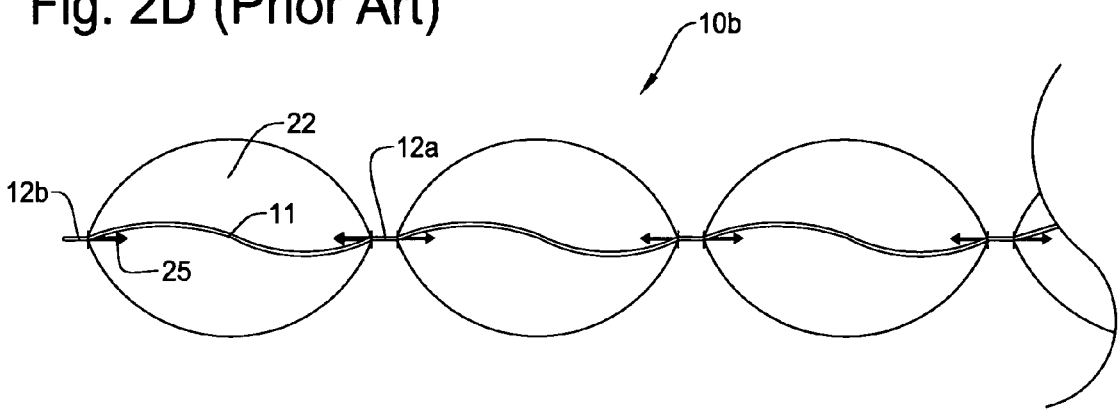
Fig. 2D (Prior Art)
Figure 2E:
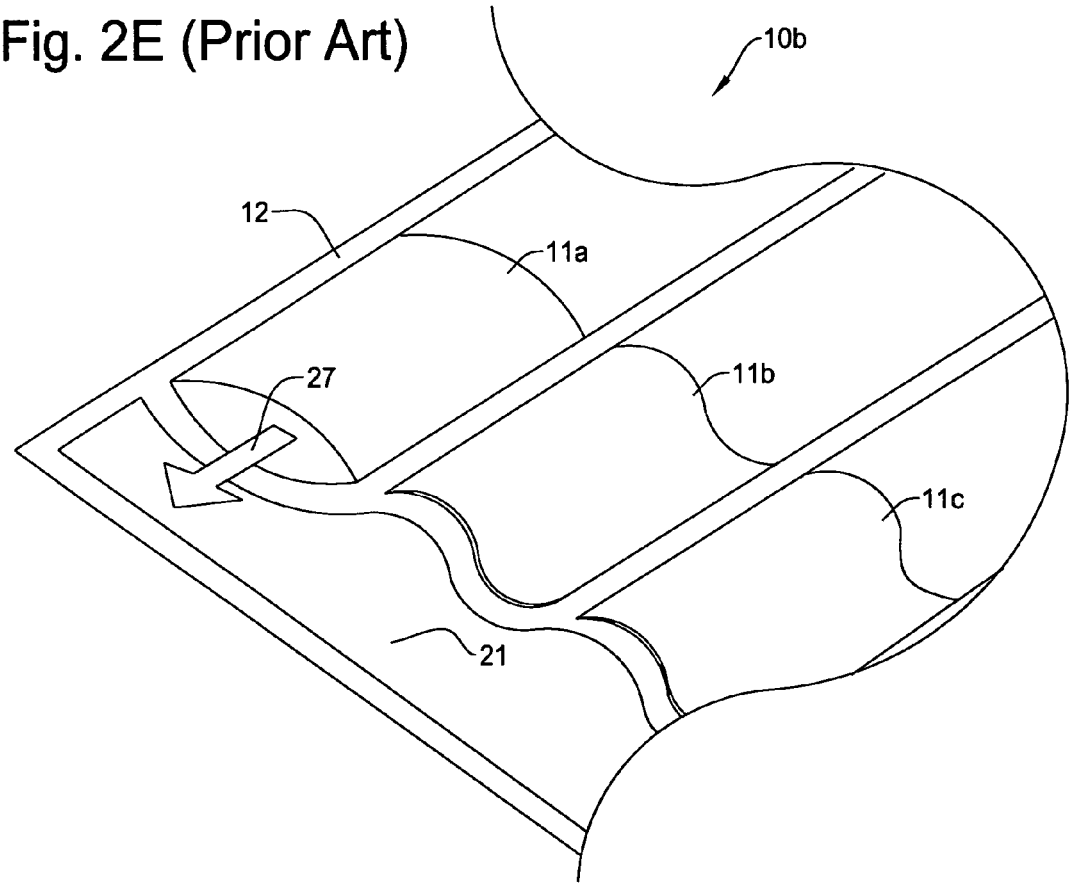
Fig. 2E (Prior Art)
Figure 3A:
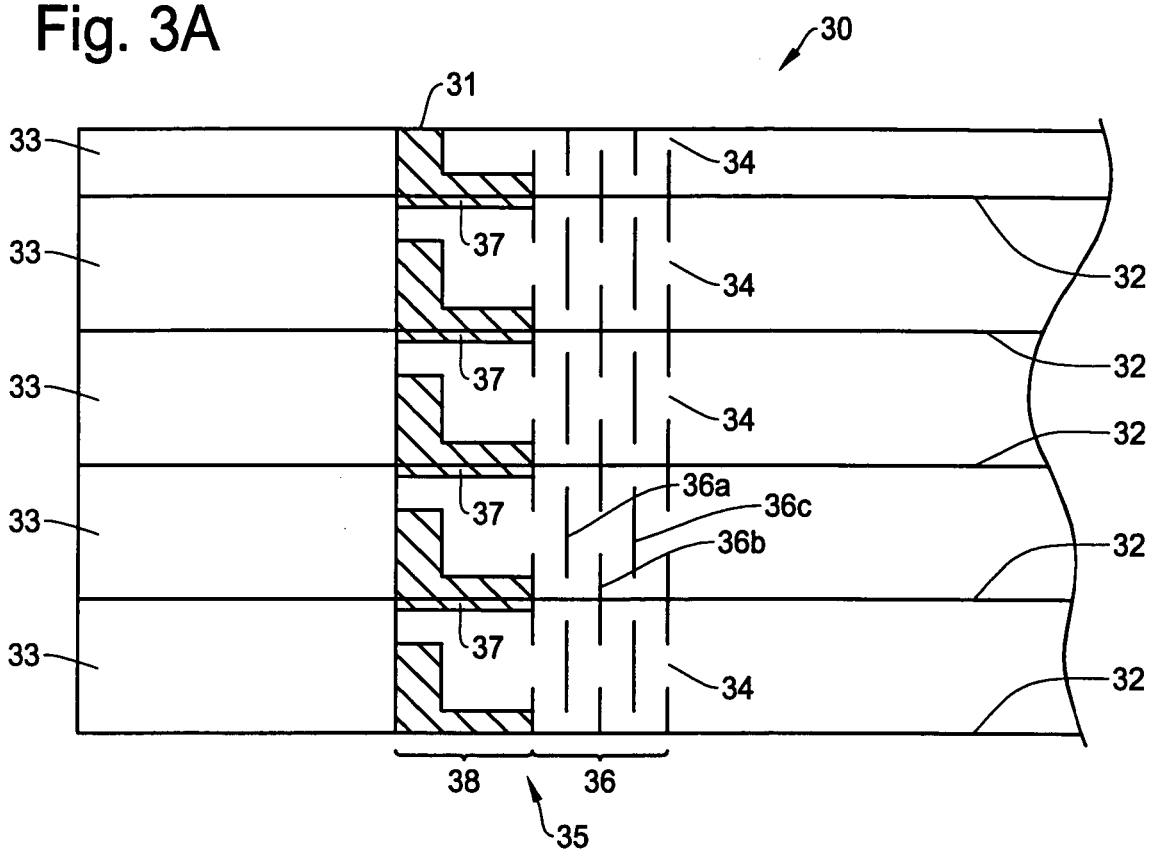
FIGS. 3A–3D show a basic concept of the check valve of the present invention where

The present invention is described in detail with reference to the accompanying drawings. FIGS. 3A–3D are plan views of the check valve for an air-packing device of the present invention. FIG. 3A shows a structure of a check valve 35 and a portion of an air-packing device 30. The air-packing device 30 having the check valves 35 is comprised of two or more rows of air cells 33. Typically, each row of air cells has a plurality of series connected air cells 33 although only one air cell is illustrated in FIG. 3A. Each air cell 33 is substantially cylindrical in shape when inflated as will be explained in more detail with reference to FIGS. 9 and 15.

Figure 4:
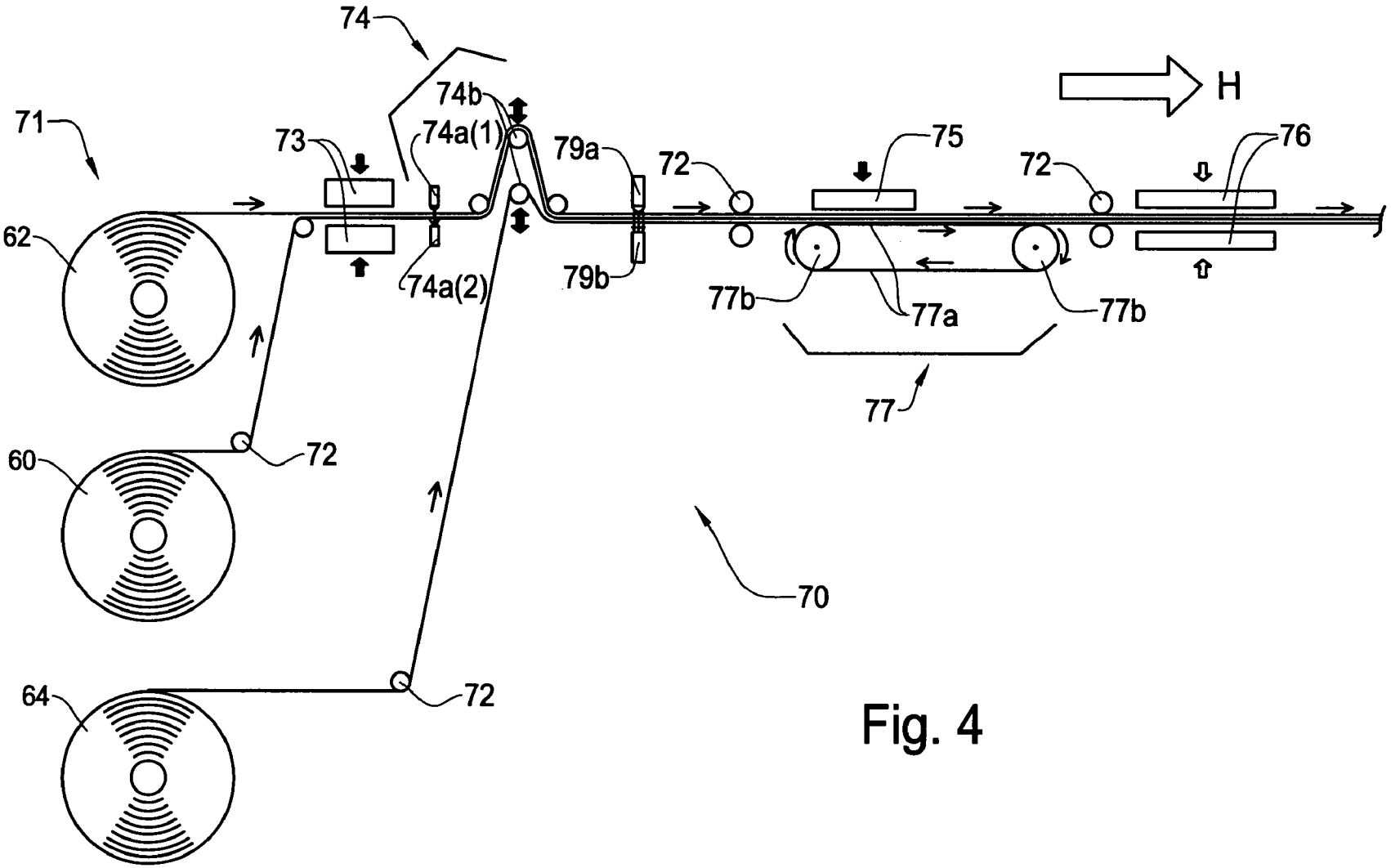
FIG. 4 is a schematic diagram showing an example of apparatus for producing the air-packing device having the check valves of the present invention.
Figure 5:
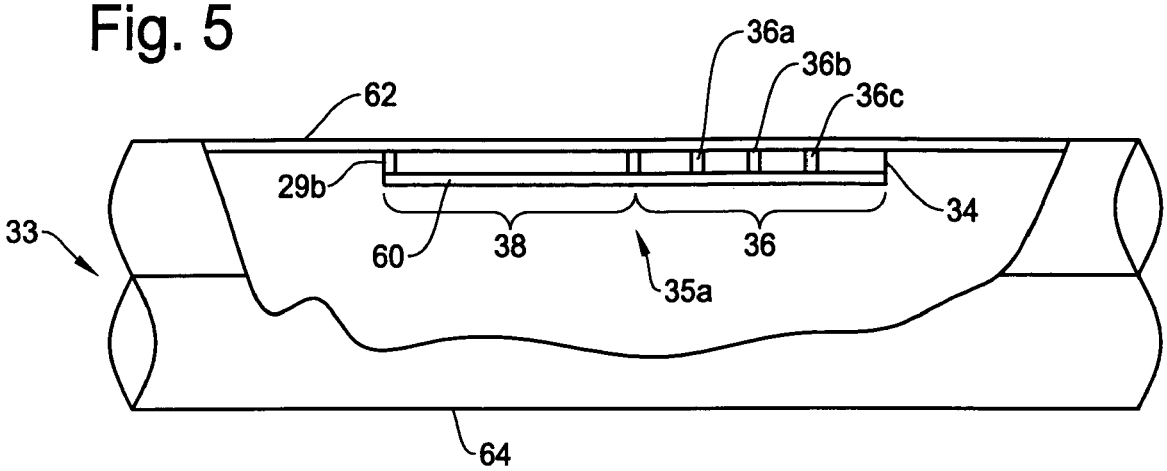
FIG. 5 is a cross sectional view showing an example of inner structure of the check valve in the present invention configured by a single layer film and formed on one of the thermoplastic films of the air-packing device.
Figure 6:
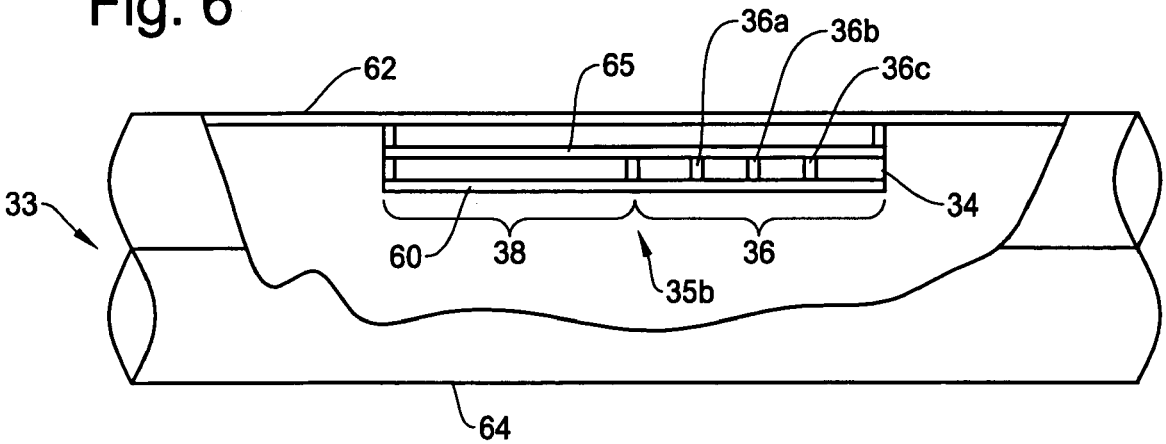
FIG. 6 is a cross sectional view showing another example of the inner structure of the check valve in the present invention configured by double layer films and formed on one of the thermoplastic films of the air-packing device.
Figure 9:
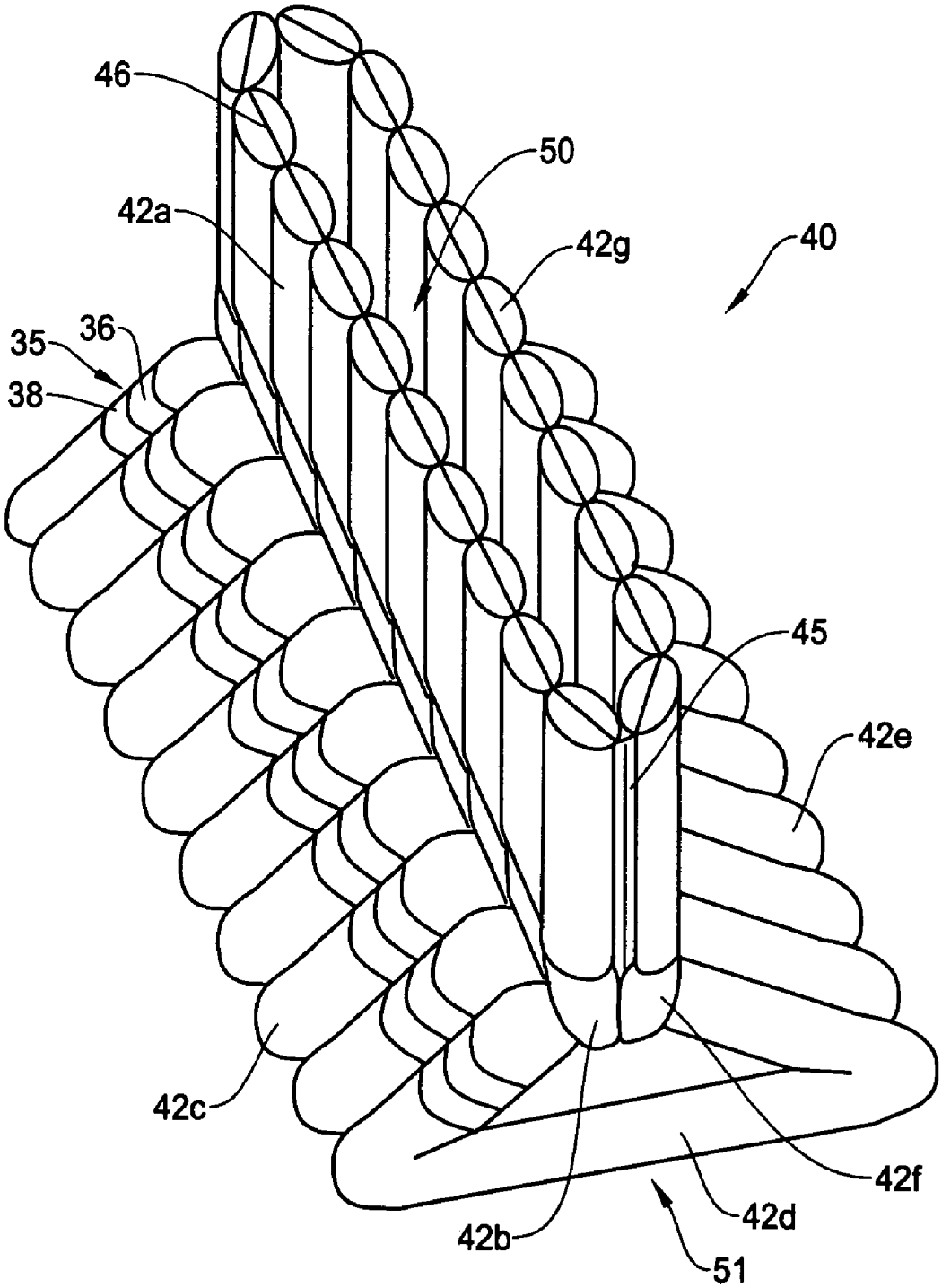
FIG. 9 is a perspective view showing an example of three dimensional structure of the air-packing device incorporating the check valve of the present invention and is formed of a cushion portion and a container portion for packing a product.

Before supplying the air, the air-packing device 30 has a shape of an elongated rectangular sheet made of a first (upper) thermoplastic film 62 and a second (lower) thermoplastic film 64 (FIGS. 4–6). In a preferred embodiment, a plurality of air cells are formed in a series fashion as shown in FIG. 9. Further, such a set of series connected air cells are aligned in a parallel fashion so that the air cells are arranged in matrix manner on the sheet.

To create such a structure, each set of series air cells are formed by bonding the first thermoplastic film 62 and the second thermoplastic film 64 by the separation line (heat-seal line) 32. Consequently, the air cells 33 are created so that each set of series connected air cells can be independently filled with the air. An example of structure of the air-packing device having the air cells in a matrix manner is best shown in FIGS. 9 and 10A.

A check valve film 60 having a plurality of check valves 35 is attached to one of the thermoplastic films 62 and 64. When attaching the check valve film 60, peeling agents 37 are applied to the predetermined locations on the sealing lines between the check valve sheet and one of the plastic films 62 and 64. The peeling agent 37 is a type of paint having high thermal resistance so that it prohibits the thermal bonding between the first and second thermoplastic films 62 and 64. Accordingly, even when the heat is applied to bond the first and second films along the heat-seal line 32, the first and second films will not adhere with each other at the location of the peeling agent 37.

The peeling agent 37 also allows the air input 31 to open easily when filling the air in the air-packing device 30. When the upper and lower films 62 and 64 made of identical material are layered together, there is a tendency that both films stick with one another. The peeling agent 37 printed on the films prevents such sticking. Thus, it facilitates easy insertion of an air nozzle of the air compressor into the air inlet 31 when inflating the air-packing device.

The check valve 35 of the present invention is configured by a common air duct portion 38 and an air flow maze portion 36. The air duct portion 38 acts as a duct to allow the flows of the air from the an air port 31 to each set of air cells 33. The air flow maze portion 36 prevents free flow of air between the air-packing device 30 and the outside, i.e., it works as a brake against the air flows. To achieve this brake function, the air flow maze portion 36 is configured by two or more walls (heat-seals) 36*a*–36*c* so that the air from the common air duct portion 38 will not straightly flow into the air cells but have to flow in a zigzag manner. At the end of the air flow maze portion 36, an exit 34 is formed.

Figure 3B:
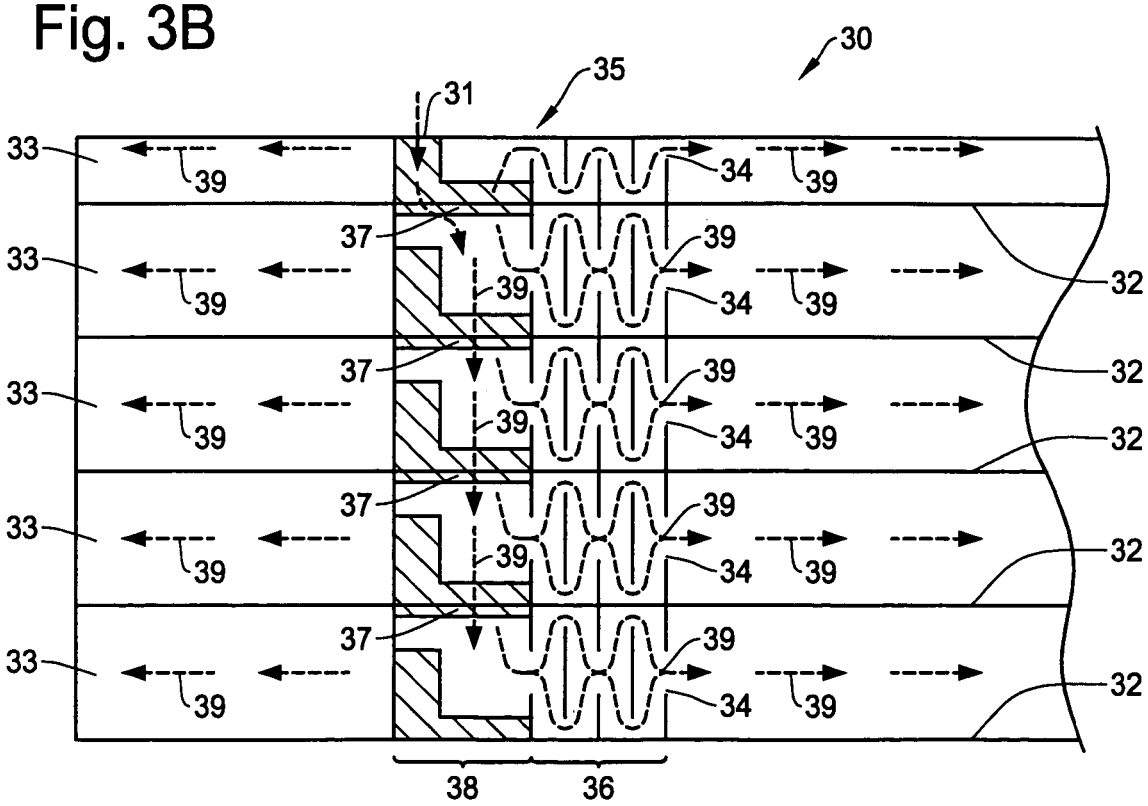

In the air-packing device 30 incorporating the check valve 35 of the present invention, the compressed air supplied to the air input 31 to inflate the air cells 33 flows in a manner as illustrated in FIG. 3B. The plan view shown in FIG. 3B includes the structure of the check valve 35 identical to that of FIG. 3A and further includes dotted arrows 39 showing the flows of the air in the check valve 35 and the air cells 33. As indicated by the arrows 39, the air from the check valve 35 flows both forward and backward directions of the air-packing device 30.

Namely, when the air is supplied to the air input 31 from the air compressor (not shown), the air flows toward the exit 34 via air duct portion 38 and the air flow maze portion 36 as well as toward the next adjacent air cell 33 via the air duct portion 38. The air exited from the exit 34 inflates the air cell 33 by flowing both forward and backward directions (right and left directions of FIG. 3B) of the air-packing device 30. The air moved to the next air cell flows in the same manner, i.e., toward the exit 34 and toward the next adjacent air cell 33. Such operations continue from the first air cell 33 to the last air cell 33. In other words, the air duct portion 38 allows the air to flow to either the present air cell 33 through the air flow maze portion 36 and to the next air cell 33.

Figure 3C:
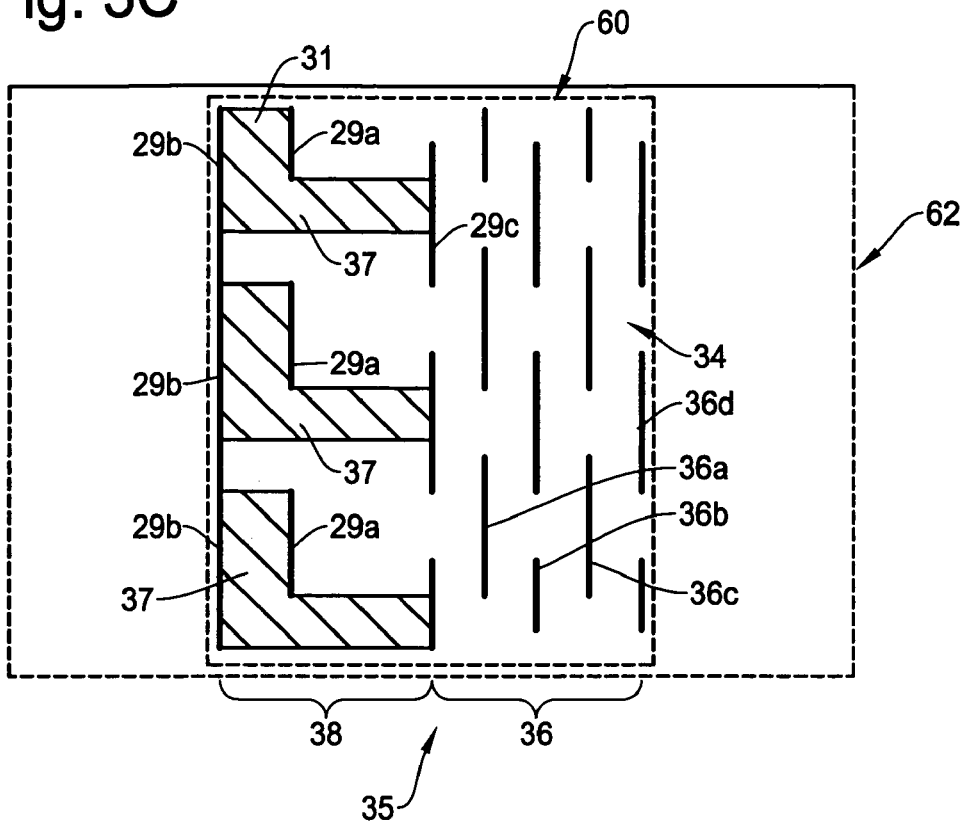
Figure 3D:
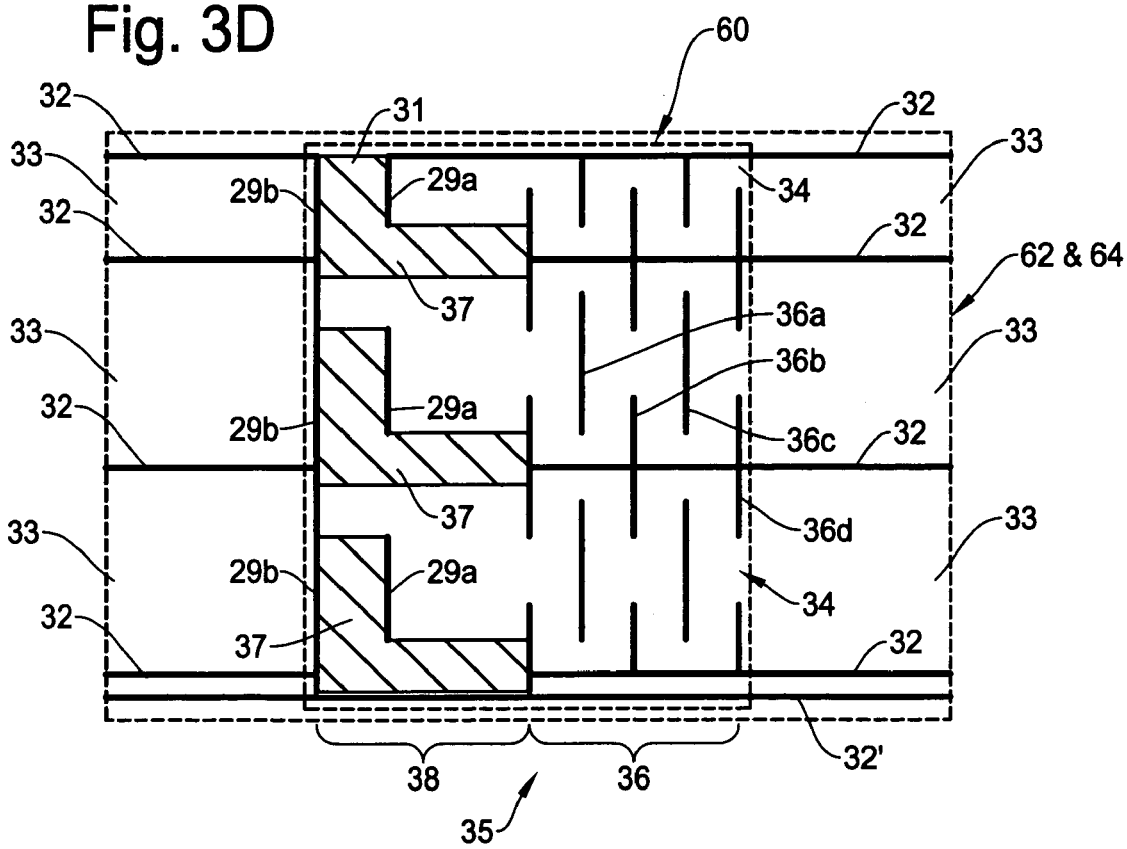

FIGS. 3C–3D show an enlarged view of the check valve of the present invention for explaining how the check valves 35 are created on the air-packing device 30. As noted above, the check valve film 60 is attached to either one of the thermoplastic film 62 or 64. The example of FIGS. 3C and 3D show the case where the check valve film 60 is attached to the upper (first) thermoplastic film 62. The thick lines in the drawings indicate the heat-seal (bonding) between the films.

The air-packing device of the present invention is manufactured by bonding the second (lower) thermoplastic film 64, the check valve film 60, and the first (upper) thermoplastic film 62 by pressing the films with a heater. Since each film is made of thermoplastic material, they will bond (welded) together when heat is applied. In this example, the check valve film 60 is attached to the upper thermoplastic film 62, and then, the check valve film 60 and the upper thermoplastic film 62 are bonded to the lower thermoplastic film 64.

First, as shown in FIG. 3C, the check valve film 60 is attached to the upper thermoplastic film 62 by heat-sealing the two films at the portions indicated by the thick lines. Through this process, the peeling agents 37 applied in advance to the check valve film 60 is attached to the upper film 62 by the bonding lines 29*a* and 29*b* to create the air duct portions 38. Further, the air flow maze portions 36 are created by the bonding lines 36*a*–36*c*, etc. At the end of the maze portion 36 is opened to establish the air exit 34.

Then, as shown in FIG. 3D, the check valve film 60 and the upper thermoplastic film 62 are attached to the lower thermoplastic film 64 by heat-sealing the upper and lower films at the portions indicated by the thick lines 32. Through this process, each air cell 33 is separated from one another because the boundary between the two air cells is closed by the bonding line (separation line) 32. However, the range of the bonding line 32 having the peeling agent 37 is not closed because the peeling agent prohibits the heat-sealing between the films. As a result, the air duct portion 38 is created which allows the air to flow in the manner shown in FIG. 3B.

FIG. 4 shows an example of a manufacturing apparatus for producing the air-packing devices incorporating the check valves of the present invention. As noted above with reference to FIGS. 3C–3D, the check valves 35 are constructed during the manufacturing process of the air-packing devices. The structure of the manufacturing apparatus of FIG. 4 is just an example, and an ordinary skilled person in the art appreciates that there are many other ways of forming an apparatus for producing the air-packing devices with use of the concept of the apparatus of FIG. 4.

The manufacturing apparatus 70 in FIG. 4 is comprised of a film feeding means 71, film conveying rollers 72, a valve heat-seal device 73, an up-down roller controller 74, a sensor 79 for feeding elongated plastic films, a main film heat-seal device 75, a belt conveyer 77 for the main heat-seal operation, and a supplemental heat-seal device 76. In the case where the main heat-seal device 75 is capable of heat-sealing all of the necessary portions of the upper and lower films 62 and 64, the supplemental heat-seal device 76 will be omitted.

The up-down roller controller 74 is provided to the manufacturing apparatus 70 in order to improve a positioning performance of the check valves. The up-down roller controller 74 moves the rollers 74*b* in perpendicular (upward or downward) to the manufacturing flow direction H in order to precisely adjust a position of the check valve film 60. Also, the belt conveyer 77 having a plastic film with high mechanical strength at high temperature such as a Mylar film on its surface is provided to the manufacturing apparatus 70 in order to improve a heat seal performance.

With reference to FIG. 4, an overall manufacturing process is described. First, the film feeding means 71 supplies the upper thermoplastic film 62, the lower thermoplastic film 64, and the check valve film 60. The film conveying rollers 72 at various positions in the manufacturing apparatus 70 guide and send the upper thermoplastic film 62, the lower thermoplastic film 64, and the check valve film 60 forward.

The first stage of the heat-sealing process is conducted by the valve heat-seal device 73. This is the process for forming the check valves 35 by attaching the check valve film 60 to the upper thermoplastic film 62. The position of each film is precisely adjusted by the up-down roller controller 74 based on the signals from the sensor 79. During this process, the check valve film 60 is bonded to the upper thermoplastic film 62 with the patterns (bonding lines) illustrated by the thick lines of FIG. 3C.

Figure 10:
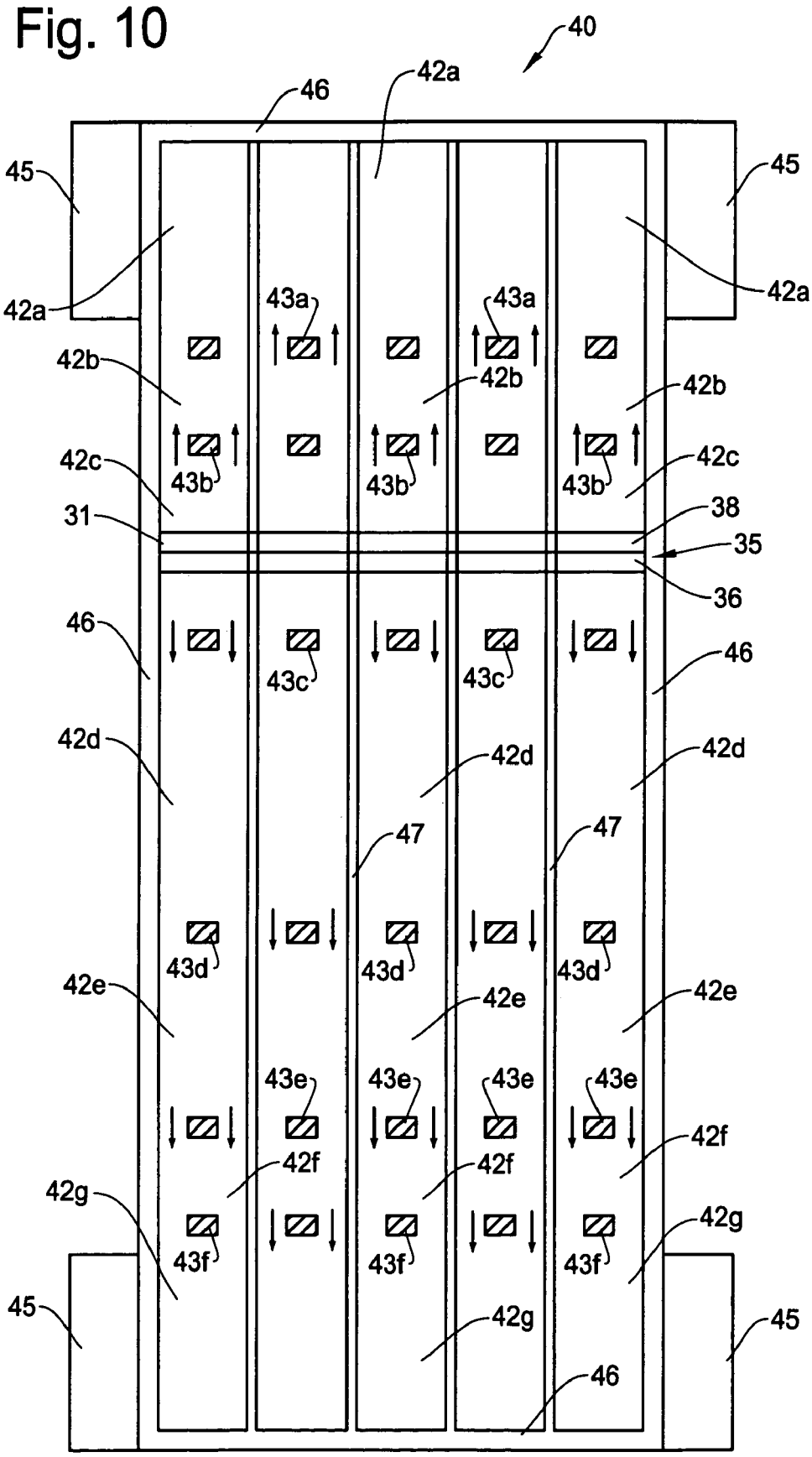
FIG. 10 is a plan view showing a sheet like structure of the air-packing device of FIG. 9 before folding and applying a post heat-sealing process for creating the shape of FIG. 9.

The second stage of the heat-sealing process is conducted by the main heat-seal device 75 and the belt conveyer 77. The main heat-seal device 75 is a heater for bonding the upper and lower thermoplastic films for creating many air cells with the bonding lines 32 illustrated by the thick lines of FIG. 3D. Typically, the main heat-seal device 75 is a large scale heater to create the sheets of air-packing device such as shown in FIG. 10. During this process or by a separate process, heat-seal lands (folding points) are also created by bonding the upper and lower thermoplastic films to define the series connected air cells.

The belt conveyer 77 is used to prevent the heat-sealed portions from extending or broken by the main heat-seal device 75. The belt conveyer 77 has two wheels 77*b* and a belt 77*a* made of or coated by a high heat resistance film such as a Mylar film. In the heat-seal process, the heat from the main heat-seal device 75 is applied to the upper and lower films 62 and 64 through the Mylar film on the conveyer belt 77*a*. The Mylar film may temporarily stick to one of the upper/lower films 62 and 64 immediately after the heat-seal process. If the Mylar film is immediately separated from the upper/lower films 62 and 64, the heat-sealed portions of the upper/lower films may be deformed or even broken.

Thus, in the manufacturing apparatus of FIG. 4, instead of immediately separating the Mylar film from the upper and lower films 62 and 64, the Mylar film moves at the same feed speed of the upper and lower films 62 and 64 because of the belt conveyer 77. During this time, the heat seal portions with temperature are naturally cured while they are temporally stuck to the Mylar film on the belt 77*a*. Thus, the upper and lower films 62 and 64 can be securely separated from the Mylar film at the end of the belt conveyor 77.

The third stage of the sealing process is performed by the supplemental seal device 76. This is the final heat-seal process to produce the air-packing device by heat-sealing the remaining heat-seal portions. In the case where the main heat-seal device 75 is able to heat-seal all of the necessary portions, the process by the supplemental seal device 76 is unnecessary. The air-packing device produced in the form of one long film may be cut and folded to create a pocket (container) like form through a post heat-seal treatment (not shown) to match the shape of the product to be protected. Processes of loading the product and inflating the air-packing device may be added.

FIG. 5 is a partial cross sectional front view showing an example of inner structure of the check valve of the present invention configured by a single layer film and formed on a thermoplastic film of the air-packing device. As described in the foregoing, the common air duct portion 38 and the air flow maze portion 36 are created between the check valve film 60 and one of the upper and lower thermoplastic films 62 and 64. In this example, the check valve film 60 is attached to the upper thermoplastic film 62 through the heat-sealing in the manner described with reference to FIG. 3C.

The air flow maze portion 36 has a maze structure such as a zig-zaged air passage to cause resistance to the air flow such as reverse flow. Such a zig-zaged air passage is created by the bonding (heat-sealed) lines 36*a*–36*c*. Unlike the straight forward air passage, the maze portion 36 achieves an easy operation for inflating the air-packing device by the compressed air. Various ways for producing the resistance of the air flow are possible, and the structure of the maze portion 36 shown in FIGS. 3A–3D and 5 is merely one example. In general, the more complex the maze structure, the less area of the maze portion 36 is necessary to adequately produce the resistance against the air flow.

FIG. 6 is a cross sectional view showing another example of the inner structure of the check valve in the present invention configured by double layer films and formed on one of the thermoplastic films of the air-packing device. In this example, an additional film 65 is provided between the upper thermoplastic film 62 and the check valve film 60. The additional film 65 and the check valve film 60 forms the check valves 35*b*. The additional film 65 is so attached to the upper film 62 that the space between the upper thermoplastic film 62 and the additional film 65 will not transmit air.

The advantage of this structure is the improved reliability in preventing the reverse flows of air. Namely, in the check valve of FIG. 5, when the air is filled in the air cell 33, the upper film 62 of the air cell having the check valve 35 is curved. Further, when a product is loaded in the air-packing device, the surface projection of the product may contact and deform the outer surface of the air cell having the check valve therein. The sealing effect created by the check valve can be weakened because of the curvature of the air cell. The additional film 65 mitigates this problem since the film 65 itself is independent from the upper film 62.

Figure 7A:
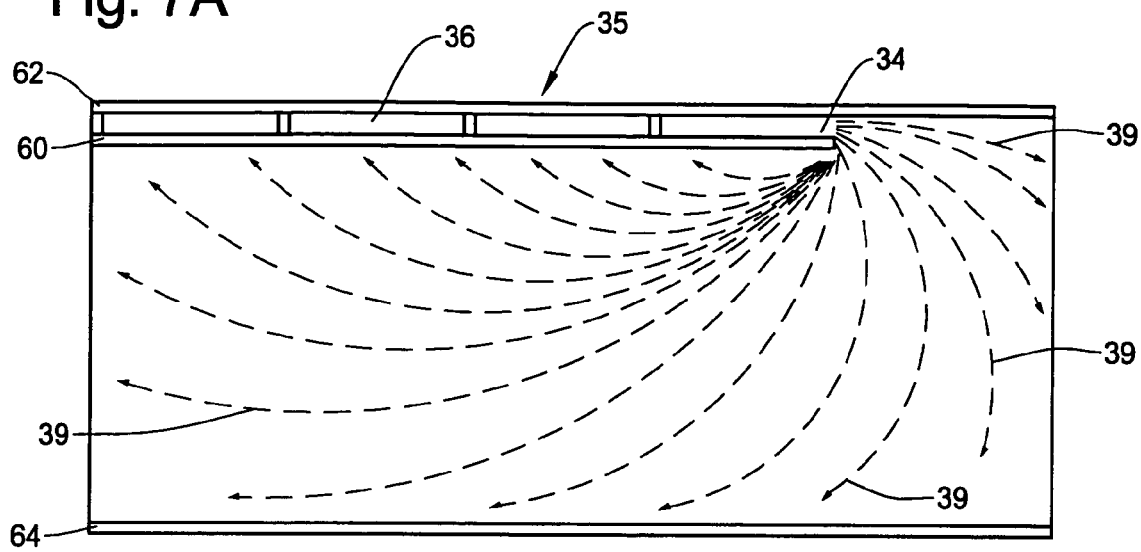
FIG. 7A is a cross sectional view showing the inner structure of a check valve of the present invention and air flows in the air cells of the air-packing device when inflating the same.
Figure 7B:
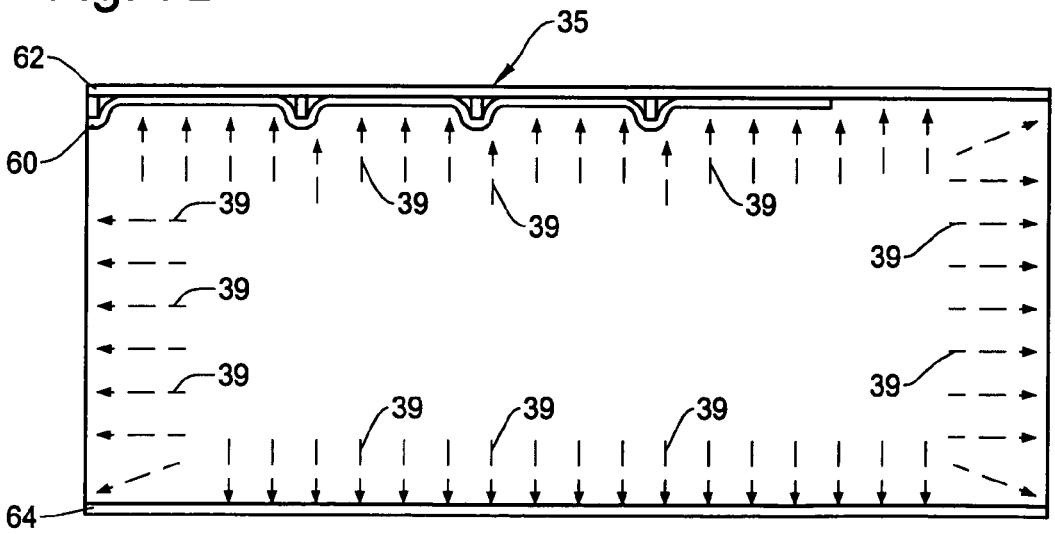
FIG. 7B is a cross section view showing the inner structure of a check valve and the air flows where the air-packing device is fully inflated so that the check valve is closed by the air pressure.

FIG. 7A and 7B are cross section views showing the inside of the air cell having the check valve 35. FIG. 7A shows the condition wherein the compressed air is being introduced into the air-packing device through the check valve 35. FIG. 7B shows the condition where the air-packing device is filled with air to an appropriate degree so that the check valve 35 is effectively sealed by the inside air pressure. The dotted arrows 39 indicate the flow of air in FIGS. 7A and 7B.

As shown in FIG. 7A, when the air is pumped in from the air input 31 (FIGS. 3A–3B), the air will flow toward each air cell. While a part of the air flows toward the next row of air cells, the remaining air goes into the present air cell to inflate the air cell. The air will flow into the air cell due to the pressure applied from the air source such as an air compressor. The air goes through the air flow maze portion 36 and exits from the exit 34 at the end of the maze portion 36. All of the air cells will eventually be filled with the compressed air.

As shown in FIG. 7B, when the air cell having the check valve 35 is inflated to a certain extent, the inner pressure of the air will push the check valve film 60 upward so that it touches the upper thermoplastic film 62. FIG. 7B mainly shows the air flow maze portion 36 of the check valve 35 to show how the check valve works. When the inner pressure reaches a sufficient level, the check valve film 60 air-tightly touches the upper thermoplastic film 62, i.e., the check valve 35 is closed, thereby preventing the reverse flows of the air.

Figure 8A:
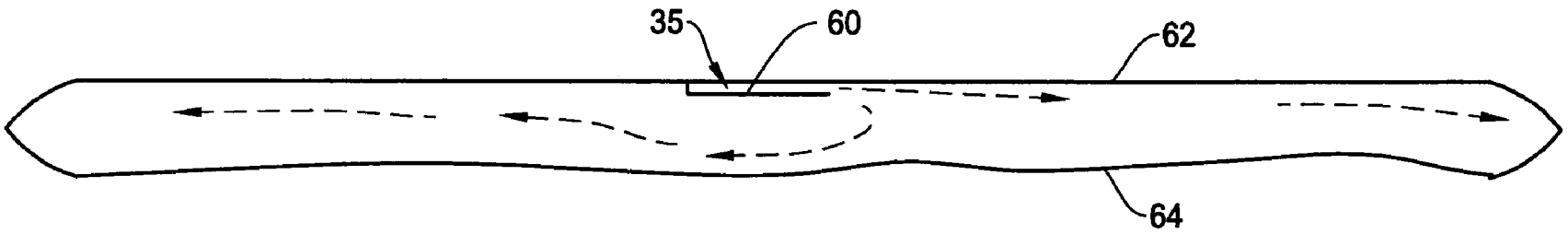
FIG. 8A is a cross sectional view showing an example of inner structure of the air-packing device having the check valve of the present invention and the air flows therein when inflating the air-packing device.
Figure 8B:
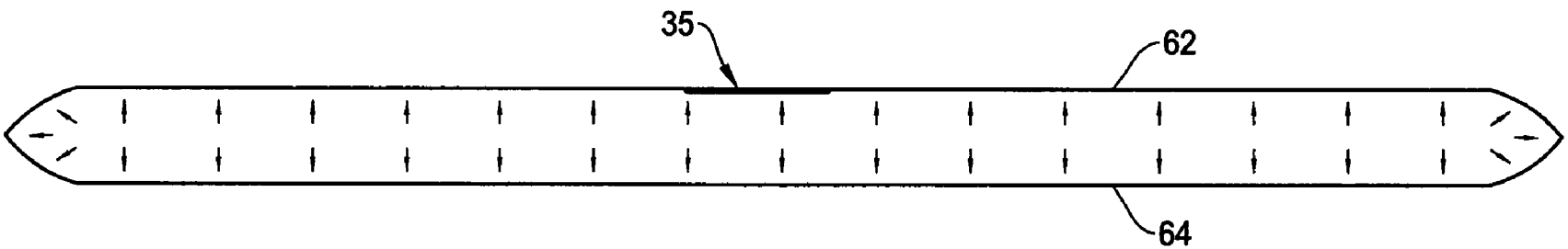
FIG. 8B is a cross sectional view showing the inner structure of the air-packing device having the check valve of the present invention and the air flows therein where the air-packing device is fully inflated so that the check valve is closed by the air pressure.

FIG. 8A and FIG. 8B show an example of one entire air cell having the check valve of the present invention when the compressed air is supplied thereto. FIG. 8A shows the condition where the air is not sufficiently filled in the air cell, thus, the air is continuously supplied to the air cell. When the air is sufficiently filled in the air cell, the check valve 35 is pressed upwardly and firmly contact with the thermoplastic film 62 as shown in FIG. 8B, thereby closing the check valve 35 to prevent reverse flow.

Because of the simple structure and small size of the check valve in the present invention, the check valve of the present invention allows a variety of forms for an air-packing device. Examples of air-packing device implementing the check valve of the present invention are shown in FIGS. 9–18B. The air-packing device is especially useful for packing a product which is sensitive to shock or vibration such as a personal computer, DVD driver, etc, having high precision mechanical components such as a hard disc driver. Other example includes wine bottles, glassware, ceramic ware, music instruments, paintings, antiques, etc. The air-packing device reliably supports the product in the container box, thereby absorbing the shocks and impacts to the product when, for example, the container box is dropped on the floor or collided with other objects.

The air-packing device of the present invention includes many air cells each having a sausage like shape when inflated and are integrally connected to one another. More specifically, two or more air cells are series connected through air passages. Each set of series connected air cells has a check valve at any location to supply the air to all of the series connected air cells while preventing a reverse flow of the compressed air in the air cells. Further, two or more such sets of series connected air cells are aligned in parallel with one another so that the air cells are arranged in a matrix manner (FIG. 10).

FIG. 9 is a perspective view showing an example of air-packing device implementing the check valve of the present invention. The air-packing device 40 of the present invention is made of a plurality of air cells as noted above. The air-packing device 40 before forming the shape of FIG. 9 has a sheet like shape as shown in the plan view of FIG. 10, which is created by a production process such as shown in FIG. 4. The shape of FIG. 9 is created by folding and heat-sealing (post heat-sealing treatment) the sheet of air-packing device of FIG. 10 before filling the air.

As shown in FIGS. 9 and 10, the air-packing device 40 has many sets (air containers) of air cells each having the check valve 35 described in the foregoing and series connected air cells 42*a*–42*g* (air-container 42). The check valve 35 is configured by the common air duct potion 38 with an air input 31 (not shown) and the air flow maze portion 36. In this example, the check valves 35 are formed on the air cells 42*c* although the check valve of the present invention can be located anywhere on the air-packing device. The air-packing device 40 also includes heat-seal flanges 45 for forming the opening (container portion) 50 of FIG. 9 by the post heat-sealing treatment.

The air-packing device 40 is composed of first and second thermoplastic films and a check valve sheet. Typically, each of the thermoplastic films is composed of three layers of materials: polyethylene, nylon and polyethylene which are bonded together with appropriate adhesive. The first and second thermoplastic films are heat-sealed together at the outer edges 46 and each boundary 47 between two sets of series connected air cells after the check valve sheet is inserted therein.

The first and second thermoplastic films are also heat-sealed at locations (heat-seal lands) 43*a*–43*f* for folding the air-packing device 40. Thus, the heat-seal lands 43*a*–43*f* close the first and second thermoplastic films at the locations on each air container but still allow the air to pass toward the next air cells as shown by the arrows at both sides of each heat-seal land 43. Since the portions on the air container at the heat-seal lands 43*a*–43*f* are closed, each of the air cells 42*a*–42*g* is shaped like a sausage when inflated as shown in FIG. 9. In other words, the air-packing device 40 can be easily bent or folded at the heat-seal lands to match the shape of the product to be protected.

Figure 11B:
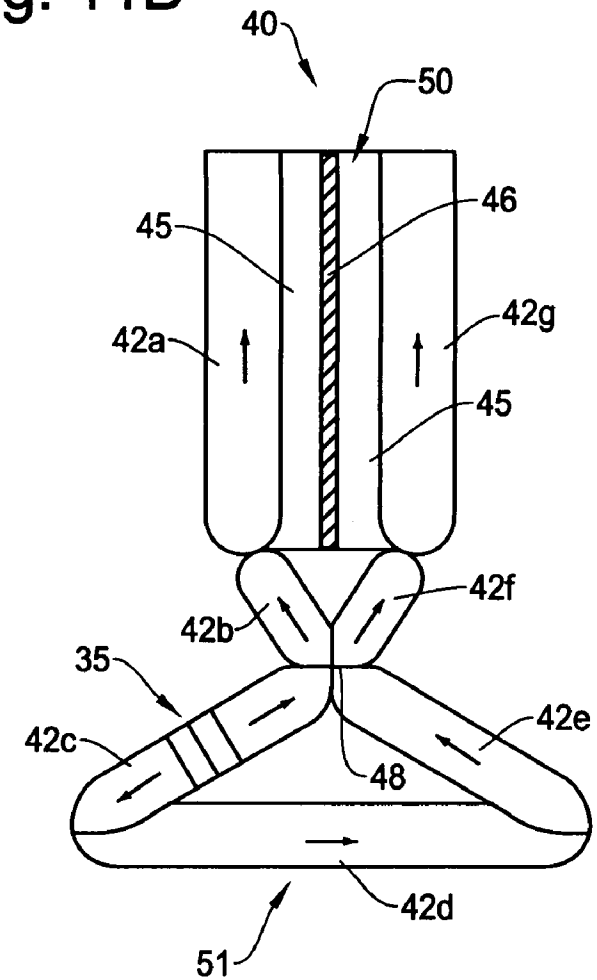
FIGS. 11A and 11B are side views showing a process of forming the air-packing device of FIG. 9 from the sheet like shape of FIG. 10, where
Figure 11A:
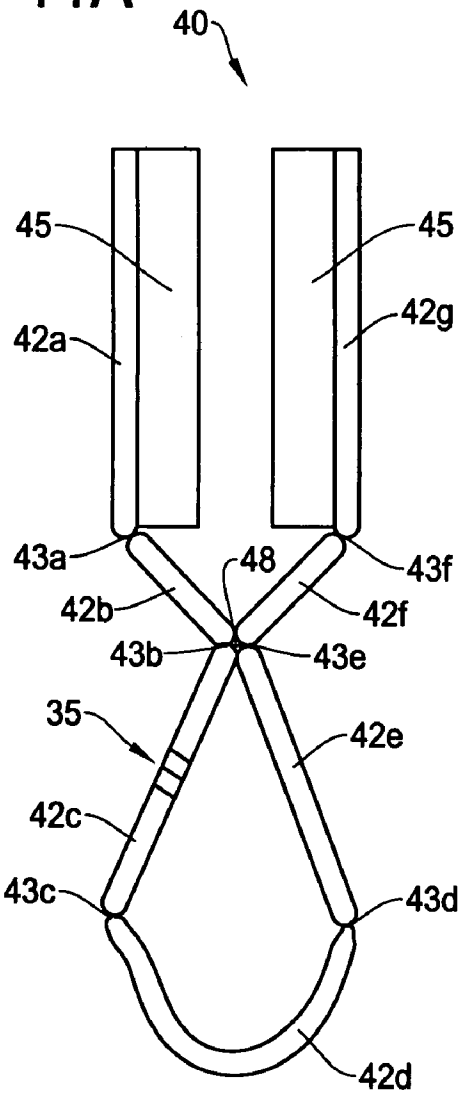

As shown in the side views of FIGS. 11A and 11B, by further applying a post heat-seal treatment to the sheet of FIG. 10, the air-packing device having a unique shape as shown in FIG. 9 is created. As shown in FIGS. 9 and 11B, the air-packing device 40 has a container (pouch) portion 50 having an opening for packing a product therein and a cushion portion 51 having a predetermined cushion shape to absorb the shock and vibration. The container portion 50 is formed at the summit of the cushion portion 51. In the example of FIGS. 9–11B, the cushion portion 51 has a shape of substantially triangle. However, other shapes such as a rectangular shape are also feasible as a cushion portion as will be explained later.

Figure 12:
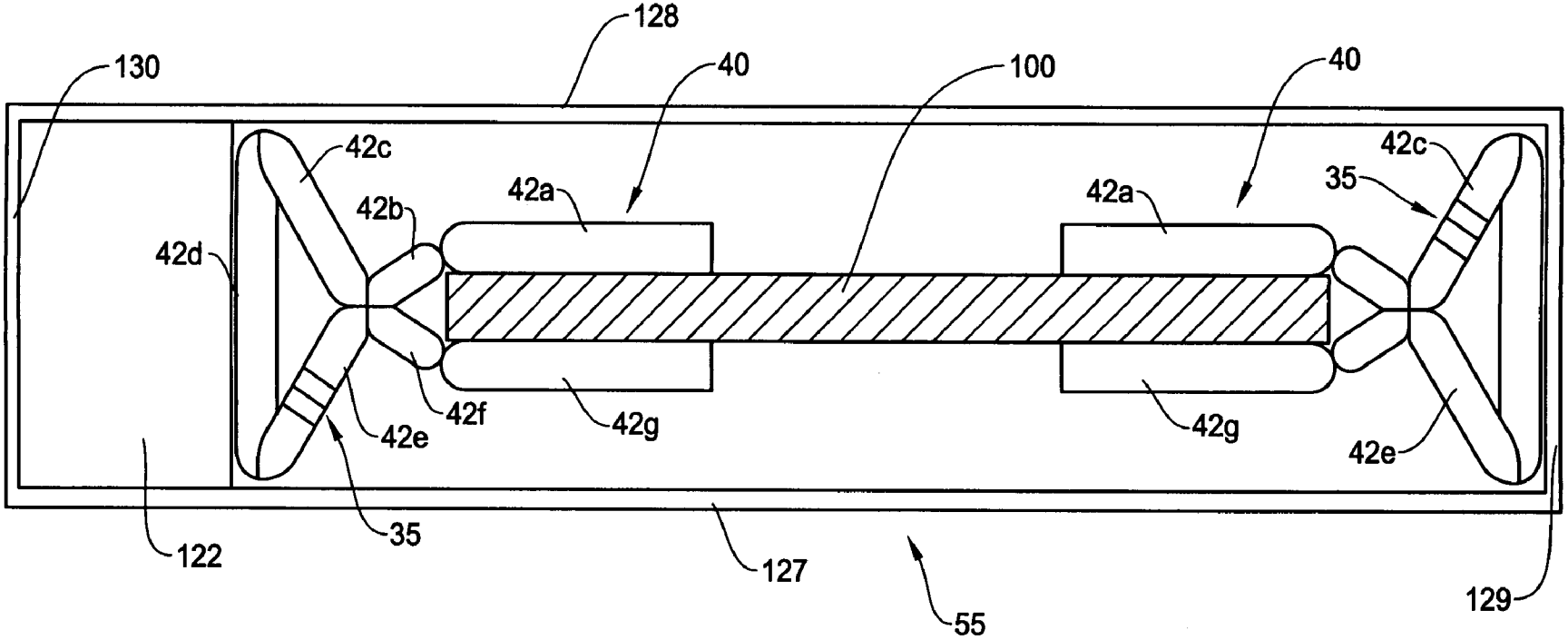
FIG. 12 is a cross sectional view showing an example of a container box in which a pair of air-packing devices of the present invention shown in FIGS. 9–10 and 11A–11B are incorporated for packing a product to prevent damages when dropped or collided.

The cushion portion 51 mainly serves to reduce the shock and impact to the product when the container box is dropped or collided against other objects, although the container portion 50 also serves to absorb the shock and impact to the product. The cushion portion 51 also serves to fit to inside walls of the container box into which the air-packing device holding the product is installed (FIG. 12). The example of FIGS. 9–11B has an outer appearance that the container portion 50 is formed on the top (heat seal point 48) of the triangularly shaped cushion portion 51.

In the post heat-seal treatment, the air-packing device 40 is folded to a predetermined shape and heat-sealed at the heat-seal lands 43*b* and 43*e* (FIG. 11A) as well as the overlapped areas 46 of the heat-seal flanges 45 (FIG. 11B). It should be noted that the heat-seal between the heat-seal lands 43*b* and 43*e* in the post heat-seal process need not be exactly the same lands but can be anywhere close to the heat-seal lands 43*b* and 43*e*. After the post heat-seal treatment, the air is supplied to the air input 41 as shown FIG. 11B. The arrows in the sausage like air cells indicate the direction of air flow when the air is introduced to the air-packing device 40.

In FIG. 11B, the air introduced from the air input 31 flows into the air cells 42*c*, then other air cells in the opposite directions as shown by arrows. Namely, the air flows in one direction to the air cells 42*b* and 42*a* while the air flows in another direction to the air cells 42*d*, 42*e*, 42*f* and 42*g*. Any appropriate means may be used to supply the air or other fluid to the air-packing device of the present invention. For instance, an air compressor with a gauge may be used that sends the air to the air-packing device 40 while monitoring the pressure. Thus, the air-packing device 40 creates the unique shape having the container portion 50 and the cushion portion 51 where the heat-seal lands 43*b* and 43*e* are bonded together at the heat-seal point 48.

As described with reference to FIGS. 3A–3D, the air input 31 is created on the check valve 35 by applying the peeling agent. The check valves 35 of the present invention can be attached to any position of the air-packing device, thus the air input 31 can be located at any position of the air-packing device 40. Since the check valves 35 and the air input are formed at the intermediate position (air cell 42*c*) rather than the very end of the air-packing device, the air can be filled in all of the air cells with a lower source pressure than that necessary by other types of check valve.

Once all of the air cells 42*a*–42*g* are inflated at a predetermined pressure, each check valve 35 provided to each set of air cells prevents the reverse flow of the air. Thus, even if one set of air cells is broken, other sets of air cells are not affected since each set of air cells has its own check valve and thus independent from the others. Because there are multiple sets of air cells, the shock absorbing function of the present invention can be maintained even when one or more air cells are broken.

FIG. 12 is a cross sectional view showing an example of container box and the air-packing device of the present invention for installing the product therein. In this example, two air-packing devices 40 are used to pack a product 100, such as a laptop computer or a DVD driver, at the both ends by the container portions 50. The container box 55 has side walls 127–130 to hold the air-packing devices 40 and the product 100 therein. In this example, a parts-box 122 is formed at one end of the container box 55 to install various components unique to the product 100 such as a cable, disc, manuals, etc.

The cushion portion 51 contacts with the inner walls of the container box 55 while the container part 50 is in the air in a floating manner. Namely, the air cell 42*d* forming the base of the triangle shape contacts with the inner wall 129 of the container box 55. Thus, when packed in the container box 55, the product 100 is held by the air-packing devices 40 and is floated within the container box 55 without directly contacting with the container box 55. Because each air cell is filled with air to an optimum pressure, the air-packing devices 40 can support the product 100 as though the product 100 floats in the container box 55. The shapes and sizes of the container portion 50 and the cushion portion 51 are designed to match the size, shape and weight of the product 100 and the container box 55. The container box 55 can be of any type, such as a corrugated carton or a wood box commonly used in the industry.

Because the pair of air-packing devices 40 support the product 100 at both sides in a substantially floating condition, the product 100 can move in the air depending on the flexibility of the air-packing devices 40 when a shock or impact is applied to the container box 55. In other words, the air-packing devices 40 can absorb the shocks and vibrations when, for example, the container box 55 is dropped to the ground or hit by other objects. The shock absorbing performance of the present invention is especially pronounced when the container box is dropped vertically.

Figure 13A:
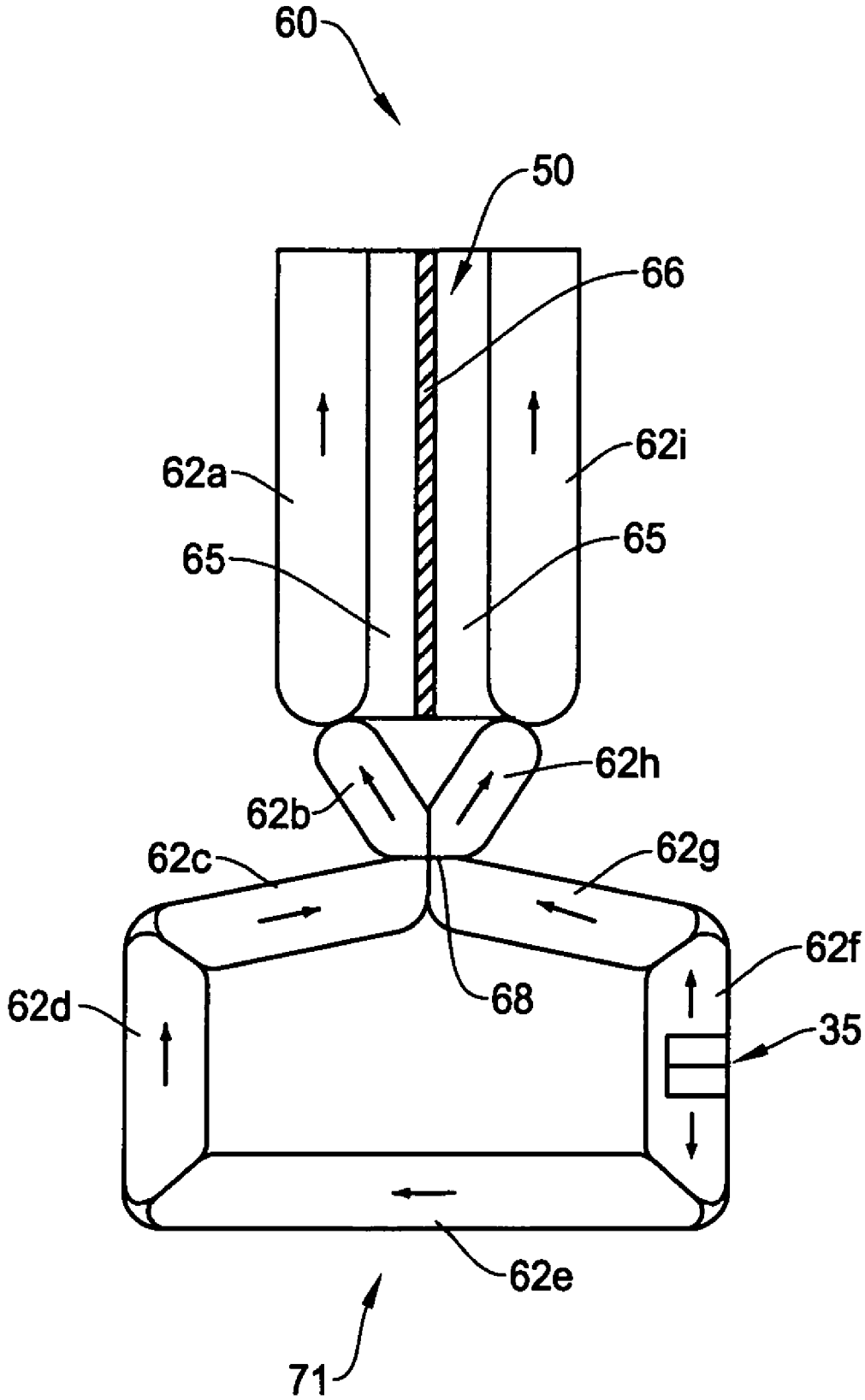
FIGS. 13A–13B show another example of the air-packing device of the present invention having a rectangular shaped cushion portion where
Figure 13B:
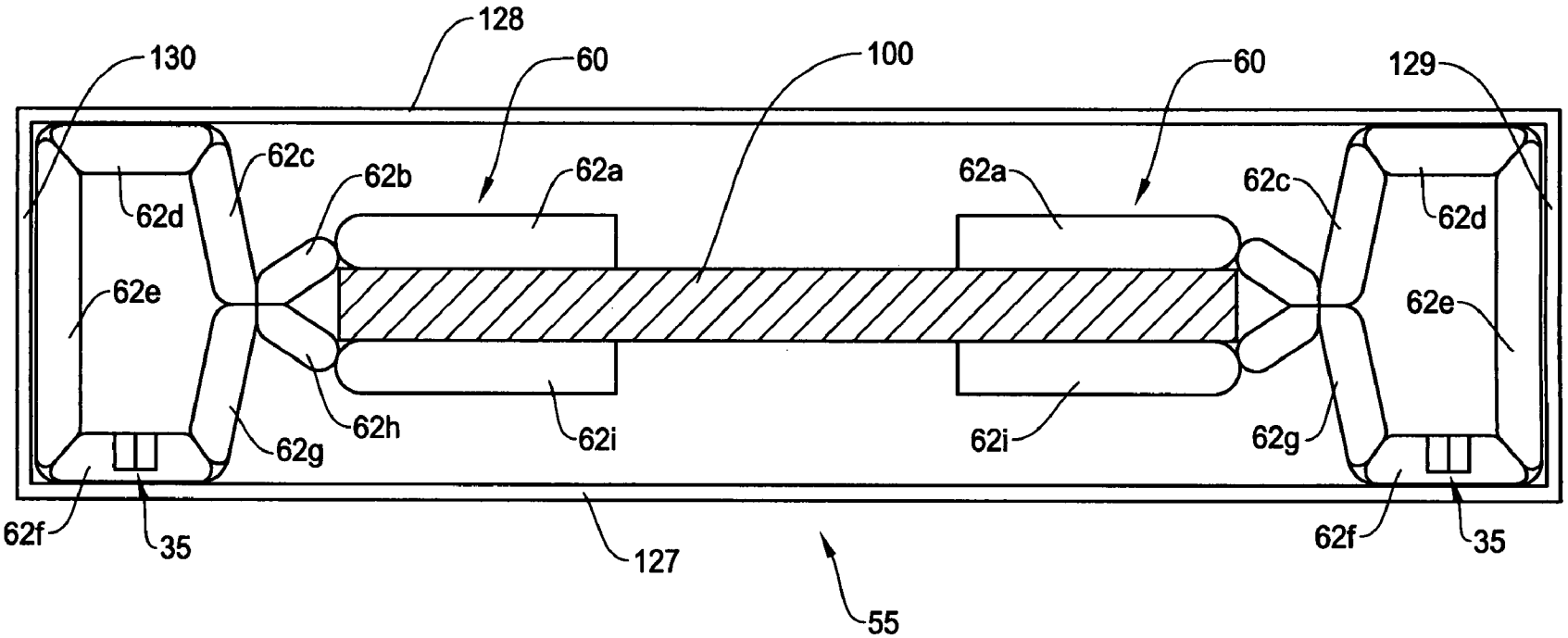

FIGS. 13A–13B show another example of the air-packing device of the present invention. FIG. 13A is a side view of the air-packing device of the present invention. FIG. 13B is a cross sectional side view showing an example of container box using two air-packing devices of the present invention. The structure of the air-packing device 60 in the example of FIGS. 13A–13B is substantially the same as that shown in FIGS. 9–12 except that the shape of the cushion portion. In the example of FIGS. 13A–13B, the cushion portion 71 has a rectangular shape rather than the triangular shape shown in FIGS. 9–12. Thus, the number of air cells is increased to form the sides of the rectangular cushion portion 71 (air cells 62*d* and 62*f*).

More specifically, the air-packing device 60 has many air containers each having a check valve 35 and series connected air cells 62*a*–62*i*. In this example, the check valves 35 are formed on the air cells 62*f*. An air input 31 is formed on the check valve 35 on one of the check valves 35 (FIG. 10) to introduce the air to all of the check valves 64 so that the air is supplied to each set of air cells 62*a*–62*i* through the corresponding check valves 35. The air-packing device 60 also includes heat-seal flanges 65 for forming the container portion 50 by the post heat-sealing treatment.

As shown in the side view of FIG. 13A, by further applying a post heat-seal treatment to the sheet of air packing device 60, the container (pouch) portion 50 having an opening for packing a product therein and the cushion portion 71 having a rectangular shape or more precisely, a pentagon shape, to absorb the shock are respectively created. The container portion 50 is formed on the summit of the cushion portion 71. The cushion portion 71 mainly serves to reduce the shocks and impact to the product when the container box is dropped or collided against other objects, although the container portion 50 also serves to reduce the shock and impact to the product. The cushion portion 71 also serves to securely fit to the inside walls of the container box into which the air-packing devices holding the product are installed (FIG. 13B) by the rectangular (pentagon) shape thereof.

After the post heat-seal treatment, the air is supplied to the air input of the check valve 35 as shown FIG. 13A. The arrows in the sausage like air cells indicate the directions of air flow when the air is introduced to the air-packing device 60. In FIG. 13A, the air introduced from the air input 31 and the check valve 35 flows in the air cell 62*f* and also in other air cells in two opposite directions. Namely, the air flows in one direction toward the air cells 62*e*, 62*d*, 62*c*, 62*b* and 62*a* while the air flows in another direction toward the air cells 62*g*, 62*h* and 62*i*. Since the check valves 35 and the air input are formed at the intermediate position (air cell 62*f*) rather than the very end of the air-packing device, the air can be filled in all of the air cells with a lower pressure of air compressor than that necessary by other types of check valve.

Once all of the air cells 62*a*–62*i* are inflated at a predetermined pressure, the check valve 35 provided to each set of air cells prevents the reverse flow of the air. Thus, even if one set of sausage like air cells is broken, other sets of air cells are not affected since each set of air cells has its own check valve and thus independent from the others. Because there are multiple sets of air cells, the shock absorbing function of the air-packing device of the present invention can be maintained.

FIG. 13B is a cross sectional view showing an example of container box using the air-packing device of the present invention. In this example, two air-packing devices 60 of FIG. 13A are used to pack a product 100, such as a laptop computer or a DVD driver, at both the ends of the product 100 by the container portions 50. The container box 55 has side walls 127–130 to hold the air-packing devices 60 and the product 100 therein.

The cushion portion 71 contacts with the side walls of the container box 55 by the air cells 62*d*, 62*e* and 62*f* while the container portion 50 is in the air in a floating manner. Thus, when packed in the container box 55, the product 100 is held by the air-packing devices 60 and is floated within the container box 55 without directly contacting with the container box 55. Because each air cell is filled with air to an optimum pressure, the air-packing devices 60 can support the product 100 as though the product 100 floats in the container box 55. The shapes and sizes of the container portion 50 and the cushion portion 71 are designed to match the size, shape and weight of the product 100 and the container box 55. The container box 55 can be of any type, such as a corrugated carton, a plastic box, or a wood box commonly used in the industry.

Because the pair of air-packing devices 60 support the product 100 at both sides in a substantially floating condition, the product 100 can move in the air depending on the flexibility of the air-packing devices 60 when a shock or impact is applied to the container box 55. In other words, the air-packing devices 60 can absorb the shocks and vibrations when, for example, the container box 55 is dropped to the ground or hit by other objects. The shock absorbing performance of the present invention is especially pronounced when the container box 55 is dropped vertically.

Figure 14:
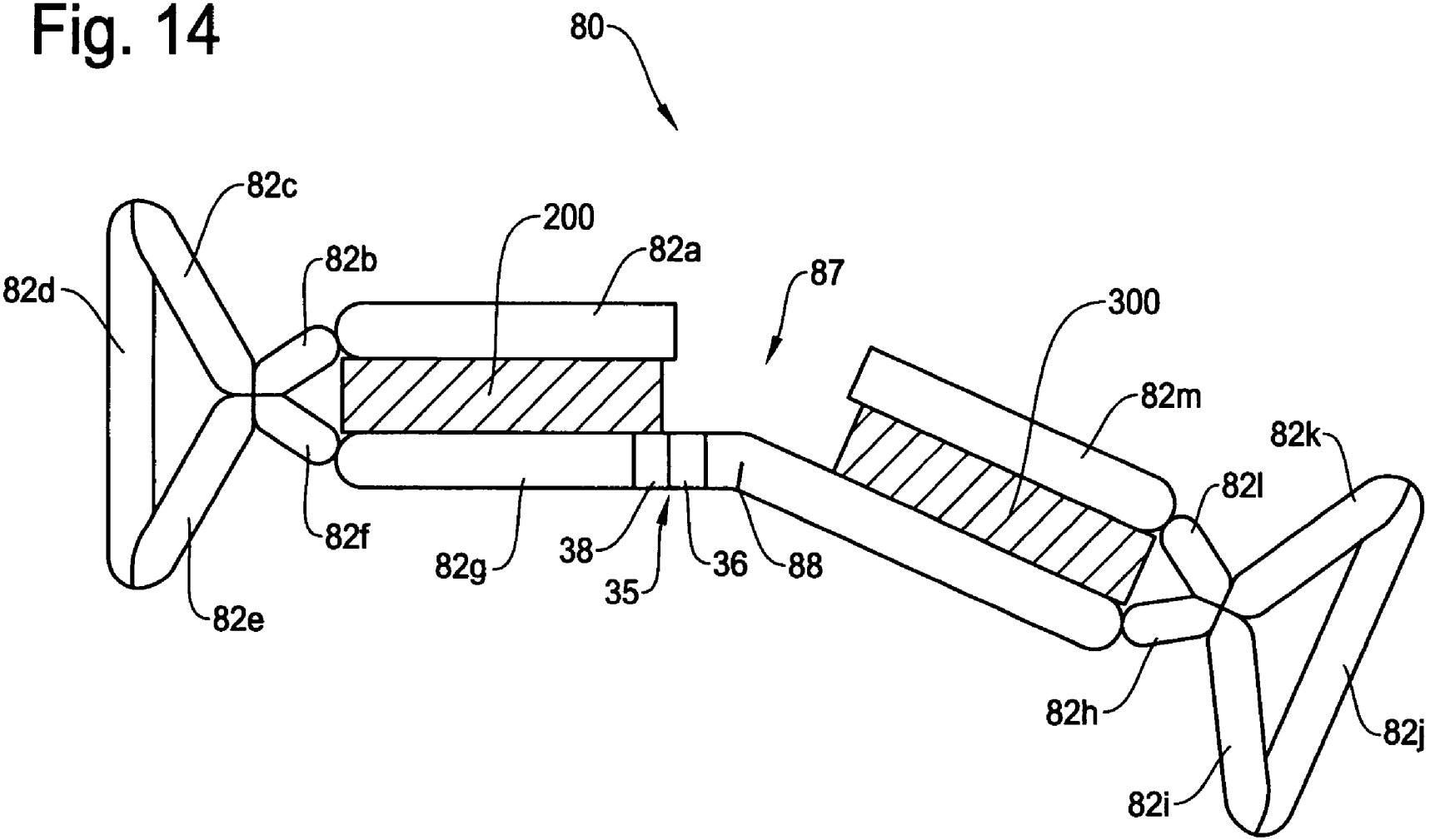
FIG. 14 is a side view showing another example of the air-packing device of the present invention where two air-packing devices of FIGS. 9–11B are integrally constructed to form one air-packing device where the cushion portions have a triangular shape.

FIG. 14 is a cross sectional side view showing a further example of air-packing device of the present invention where two air-packing devices 40 such as shown in FIGS. 9–11B are integrally constructed to form one air-packing device having two container portions (pockets) and two cushion portions. The air-packing device 80 has a plural sets of series connected air cells 82*a*–82*m* defined by heat-seal lands 83*a*–83*l*. In this example, the check valves 35 are formed on the air cells 82*g*. Two separate products 200 and 300 can be installed in the container portions of the air-packing device 80 through an opening 87. Alternatively, one product such as a laptop computer or a DVD driver can be loaded in a manner similar to FIGS. 12 and 13B.

When loading the products 200 and 300, the air-packing device 80 is bent at a bending point 88 either prior to supplying the compressed air or after filling the air so that the products 200 and 300 can be easily introduced through the opening 87. After the products 200 and 300 are securely placed in the container portions, the air-packing devices 80 are returned to a normal shape. Then, the air-packing device 80 and the products therein are placed in a container box in a manner similar to that described above with reference to FIGS. 12 and 13B.

In the example of FIG. 14, because both ends of the air-packing device are integrally formed, two separate air-packing devices are not required, which makes it easy to stock the air-packing device, Further, since the air-packing device 80 is configured by one sheet, it increases the efficiency of inflating the air-packing device and loading the products in the container parts. Further, since the air-packing device 80 is configured by one sheet, only one check valve can be used for each set of series air cells, thereby reducing the material cost.

Figure 15:
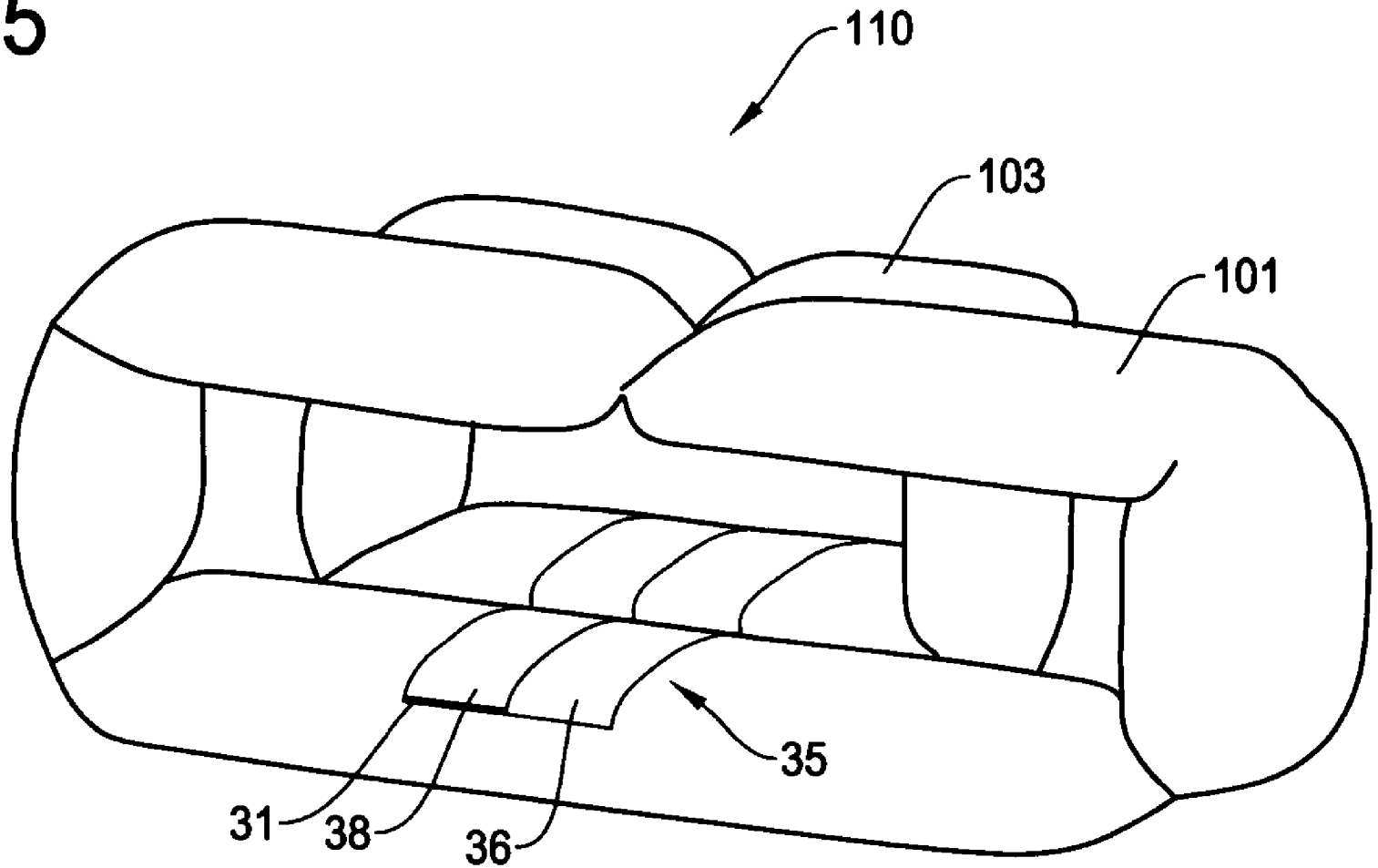
FIG. 15 is a perspective view showing another example of air-packing device incorporating the check valve of the present invention that is preferably used for packing the corner of a product.
Figure 16A:
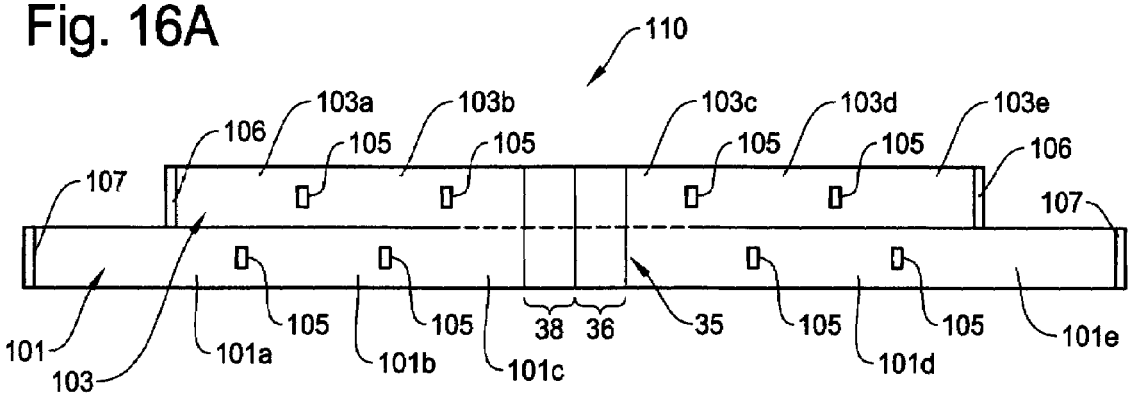
FIG. 16A is a plan view showing the air-packing device of FIG. 15 in a sheet like form before being folded.
Figure 16B:
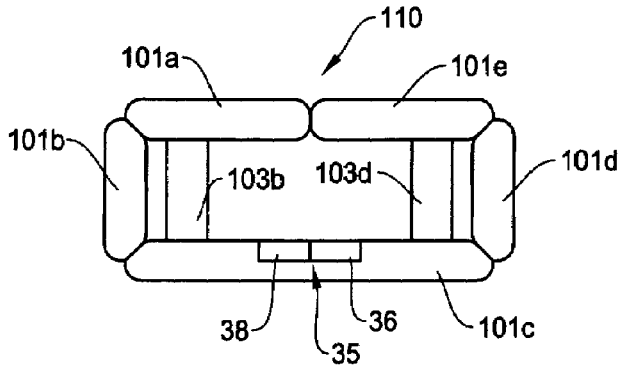
FIG. 16B is a front view showing the inflated air-packing device of FIG. 15 after folding and bonding through the post heat-seal treatment.
Figure 16C:
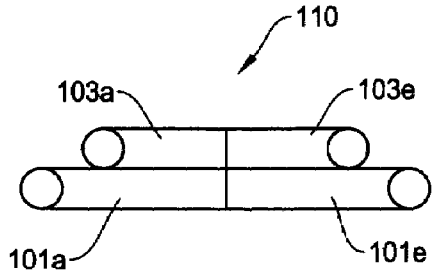
FIG. 16C is a top view of the air-packing device of FIG. 15.
Figure 17:
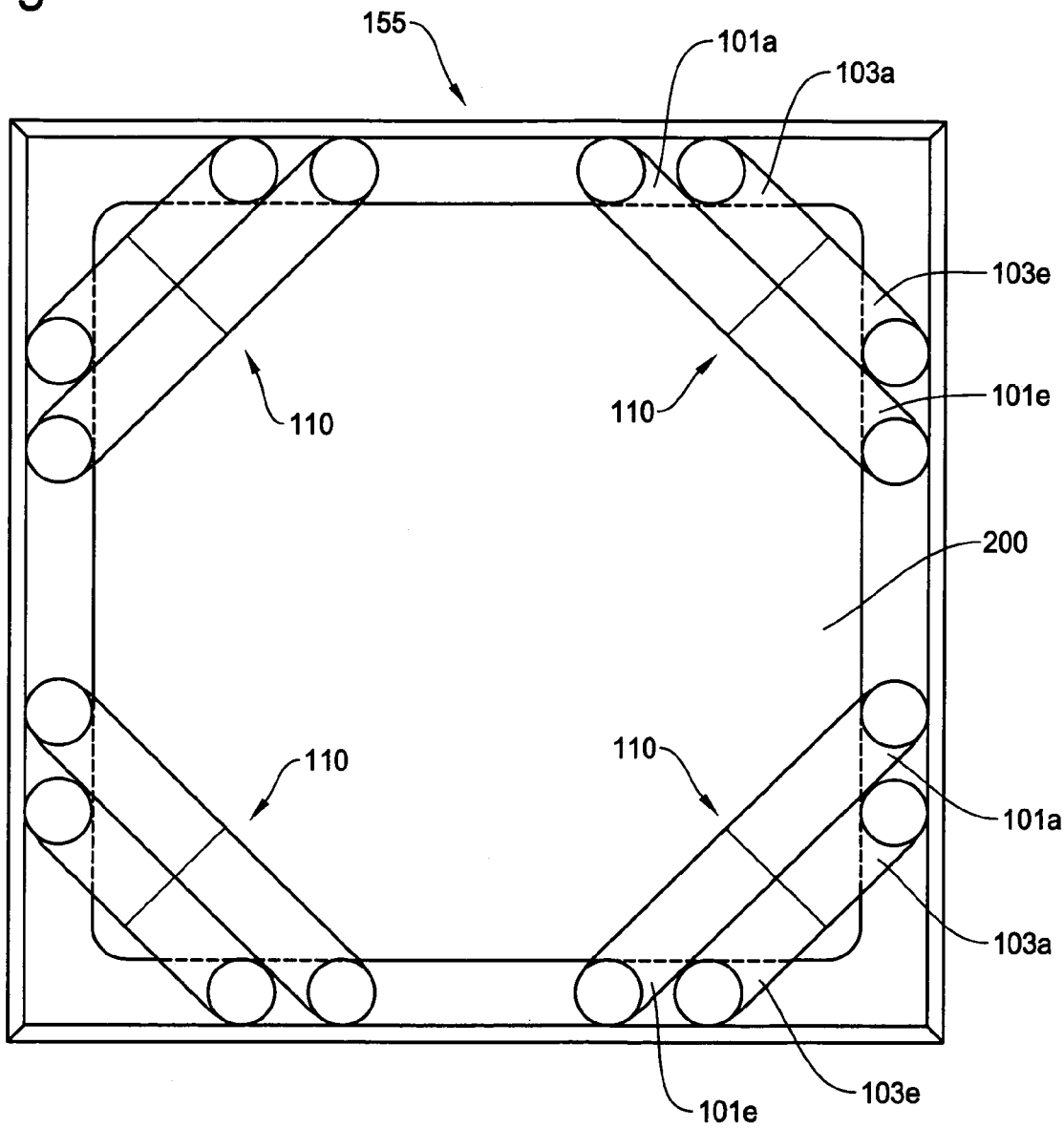
FIG. 17 is a plan view showing the inside of the container box incorporating the air-packing devices of FIG. 15 at each corner thereof for packing the four corners of the product therein.

FIGS. 15–17 show a further example of an air-packing device utilizing the check valve of the present invention. This example is preferably used to hold corners of a product to securely pack the product in a container box, although other applications are also possible. As shown in the perspective view of FIG. 15, the air-packing device 110 has a long air container 101 and a short air container 103.

FIG. 16A is a plan view showing the air-packing device 110 in the sheet like form. The long air container 101 is configured by series connected air cells 101*a*–101*e* defined by heat seal lands (folding points) 105. The short air container 103 is configured by series connected air cells 103*a*–103*e* defined by heat seal lands (folding points) 105. As noted above, the upper and lower thermoplastic films are heat-sealed at the heat-seal lands 105. In this example, the long air container 101 and the short air container 103 are physically connected at the area shown by the dotted line therebetween. The solid lines between the air containers 101 and 103 indicate that the air containers 101 and 103 in that areas are separated from one another. The air-packing device 110 also has heat-seal edges 116 and 117 for the post heat-seal treatment.

The post heat-seal treatment is applied to the sheet of air-packing device 110 shown in FIG. 16A to bond the heat-seal edges 106 at the two ends together as well as the heat-seal edges 107 at the two end together to form a ring. Then in FIG. 16B, the air-packing device 110 is inflated by supplying the compressed air through the check valve 35. Since the air container 101 is longer than the air container 103, the opening at the front formed by the air container 101 (air cells 101*a*–101*e*) is larger than the opening at the rear formed by the air container 103 (air cells 103*a*–103*e*) as shown in FIGS. 15 and, 16B–16C.

This construction allows to hold a product securely as shown in the plan view of FIG. 17 at four corners of the product 200. The opening of each of the four air-packing devices 110 supports the corner of the product 200 and installed in a container box 155 in the manner shown in FIG. 17. Because the air-packing device 110 has an outer shape that snugly fits with the inner walls of the container box 155, it can protect the product 200 from the shock or vibrations.

Figure 18A:
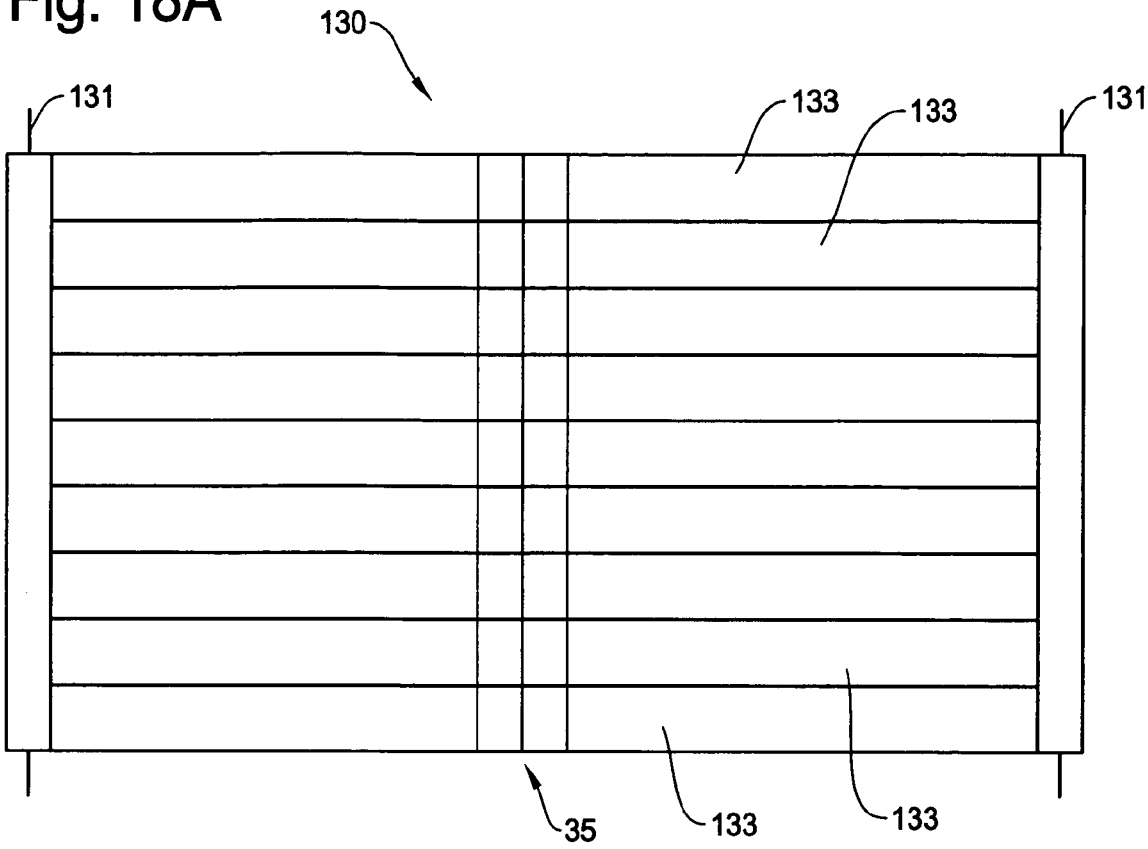
FIGS. 18A–18B show another example of air-packing device implementing the check valve of the present invention for wrapping the product without the post heat-seal process where
Figure 18B:
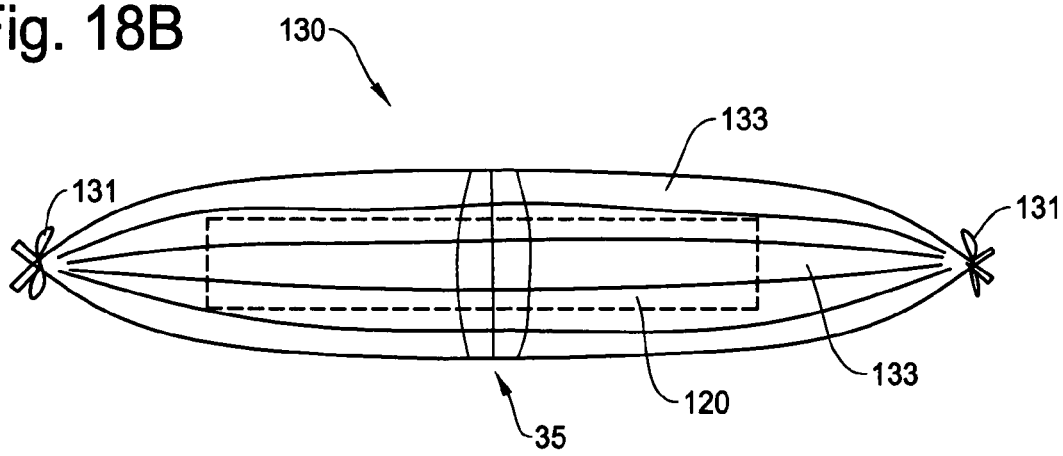

FIG. 18A and FIG. 18B show a further example of the air-packing device utilizing the check valve of the present invention. As shown in FIG. 18A, the basic construction of the air-packing device 130 is the same as the basic structure explained with reference to FIG. 3A–3D except that strings 131 are tucked in at both ends of the air cells 133. The procedure to tuck in the strings 131 to the sides of the air-packing device 130 can be performed manually or by a special tool.

A product 120 is placed on the air packing device 130 before or after supplying the air and is wrapped around by the air-packing device. The air-packing device 130 securely holds the product 120 by tightening the strings 131 at both ends. Thus, the air-packing device 130 is able to protect the product from the shocks and other impacts that arise in the product distribution stage.

In the air-packing device described in the foregoing, the heat-seal lands which bond the two layers of plastic films to create folding (bending) locations are formed in a manner shown in FIGS. 5, 11A and 15A. For example, in FIG. 5, the heat-seal lands 43*a*–43*f* define the series connected air cells 42*a*–42*g* each having a sausage like shape, thereby enabling to bend the air-packing device 40 to an appropriate shape for packing the product. The heat-seal lands 43 are created during the production process of FIG. 4 described above which forms the sheet like shape of the air-packing device.

Figure 19A:
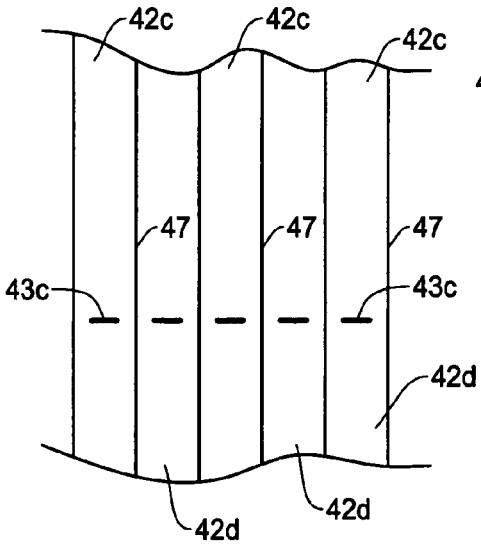
FIGS. 19A–19C are schematic diagrams showing an example of locations of the heat-seal lands on the air-packing device of the present invention where
Figure 19B:
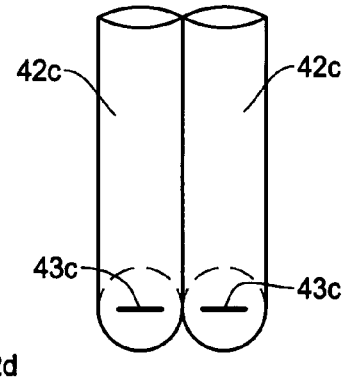
Figure 19C:
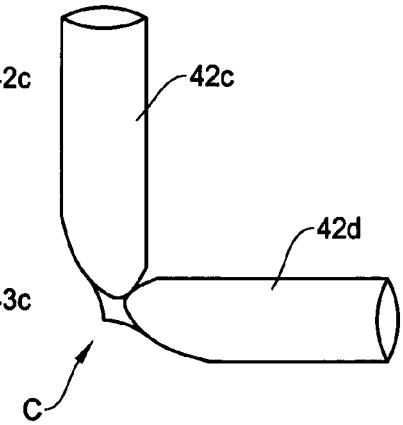

The heat-seal lands in the above example are formed at the center of the air cells. This example is shown in more detail in FIGS. 19A–19C which correspond to the air-packing device 40 shown in FIGS. 9–12. FIG. 19A is a plan view of the air-packing device when it is in the sheet form, FIG. 19B is a plan view of the air-packing device when it is inflated, and FIG. 19C is a side view of the air-packing device when it is inflated. The example of FIGS. 19A–19C show the air cells 42*c*–42*d* and the heat-seal land 43*c* between the air cells 42*c* and 42*d*.

As described with reference to FIG. 10, when the heat-seal land is located at the center of the air cell, the air flows the sides of the air cell toward the next air cell. In this structure, two air passages of small diameter will be created at both sides of the heat-seal land 43. Since the heat-seal land 43 is closed, when bent as shown in FIG. 19C, the small air passages form a shape of a small bump at the corner C. Thus, the corner C does not have a round shape of sufficient size to contact the inner walls of the container box or absorb an impact from the container box. Thus, the shock absorbing capability at the bending corner C tends to be low because the surface of the corner does not sufficiently contact with the inner walls of the container box. Moreover, it is not aesthetically pleasing because the corner C is not very rounded.

Figure 20A:
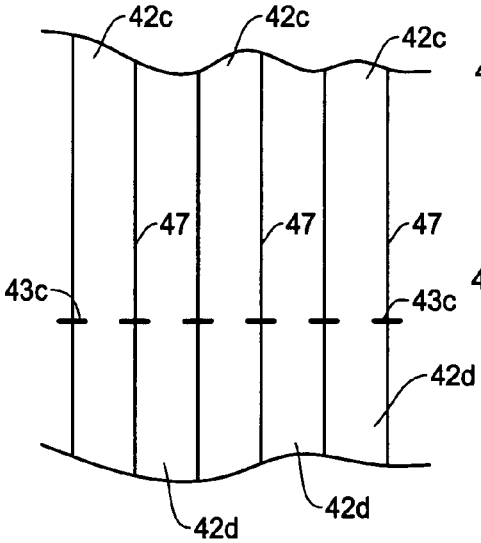
FIGS. 20A–20C are schematic diagrams showing another example of locations of the heat-seal lands on the air-packing device of the present invention where
Figure 20B:
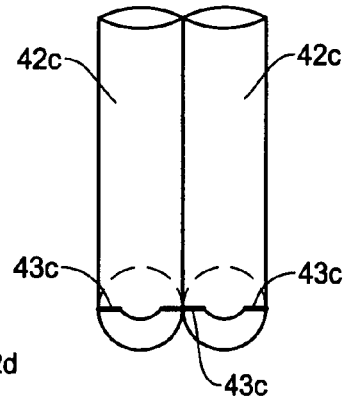
Figure 20C:
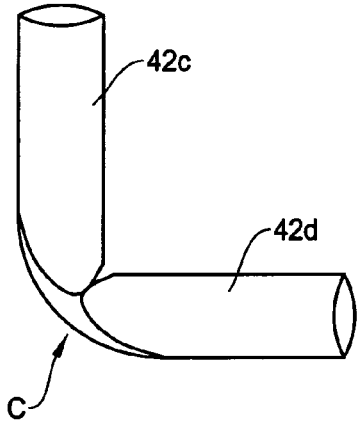

FIGS. 20A–20C are schematic diagrams showing another example of locations of the heat-seal lands on the air-packing device of the present invention where FIG. 20A is a plan view when the air-packing device is in the sheet form, FIG. 20B is a plan view when the air-packing device is inflated, and FIG. 20C is a side view thereof. In this example, the heat-seal lands 43*c* are formed on the boundary (separation line) 47 which is formed by the bonding the thermoplastic films to separate the series connected air cells. Thus, the air flows through the center of the air cell to the next air cell rather than the side thereof.

For each air cell, since a single air passage is formed at the center as shown in FIG. 20B, and the heat-seal lands 43*c* are formed on the boundary 47 which is also closed, the air passage has a larger size than that shown in FIGS. 19A–19C. Thus, the corner C of the air-packing device has a smooth and round shape in side view as shown in FIG. 20C. The round corners C tend to more snugly match and contact with the corner and the inner walls of the container box. Thus, this example has a better shock absorbing property than that of FIGS. 19A–19C. Further, the structure of FIGS. 20A–20B creates smooth and round corners that are aesthetically appreciated.

In the foregoing example, the peeling agent 37 on the check valve film 60 has a shape of letter "L" as shown in FIGS. 3A–3D. The advantage of this shape is that it allows a nozzle of an air source such as an air compressor to easily fit to an air inlet 31 to fill the air in the air-packing device 30. Typically, the sheet of air-packing device 30 is cut at the end of the production process of FIG. 4. For example, the air packing device may be cut in such a way that the vertical line of "L" shaped peeling agent 37 of the check valve 35 at the uppermost position of FIGS. 3A can function as the air input. Thus, the L-shaped peeling agent 37 is suitable for establishing the air input 31 of appropriate size by the vertical line while achieving a sufficient size of the air duct portion 38 by the horizontal line. However, the peeling agent can take various other forms to establish the check valve of the present invention.

Figure 21A:
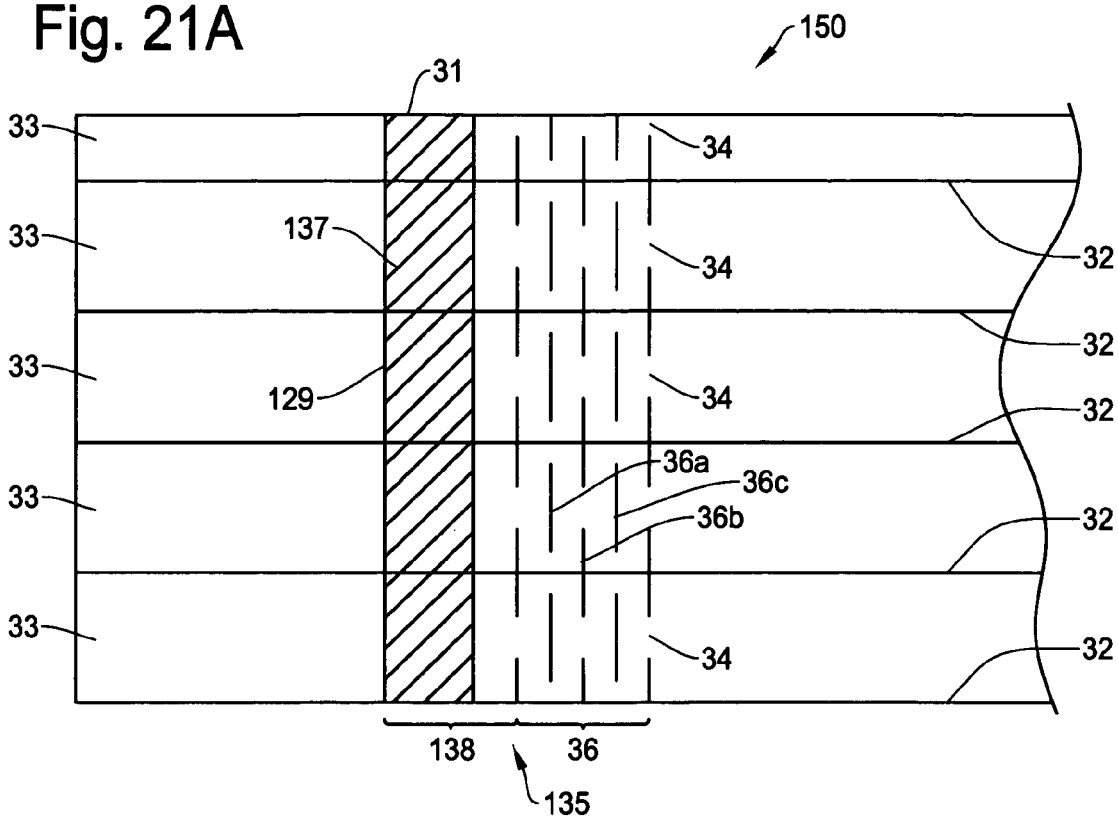
FIGS. 21A–21B are plan views showing further examples of structure of the check valve of the present invention where the patterns of peeling agents different from that of FIGS. 3A–3D are incorporated.
Figure 21B:
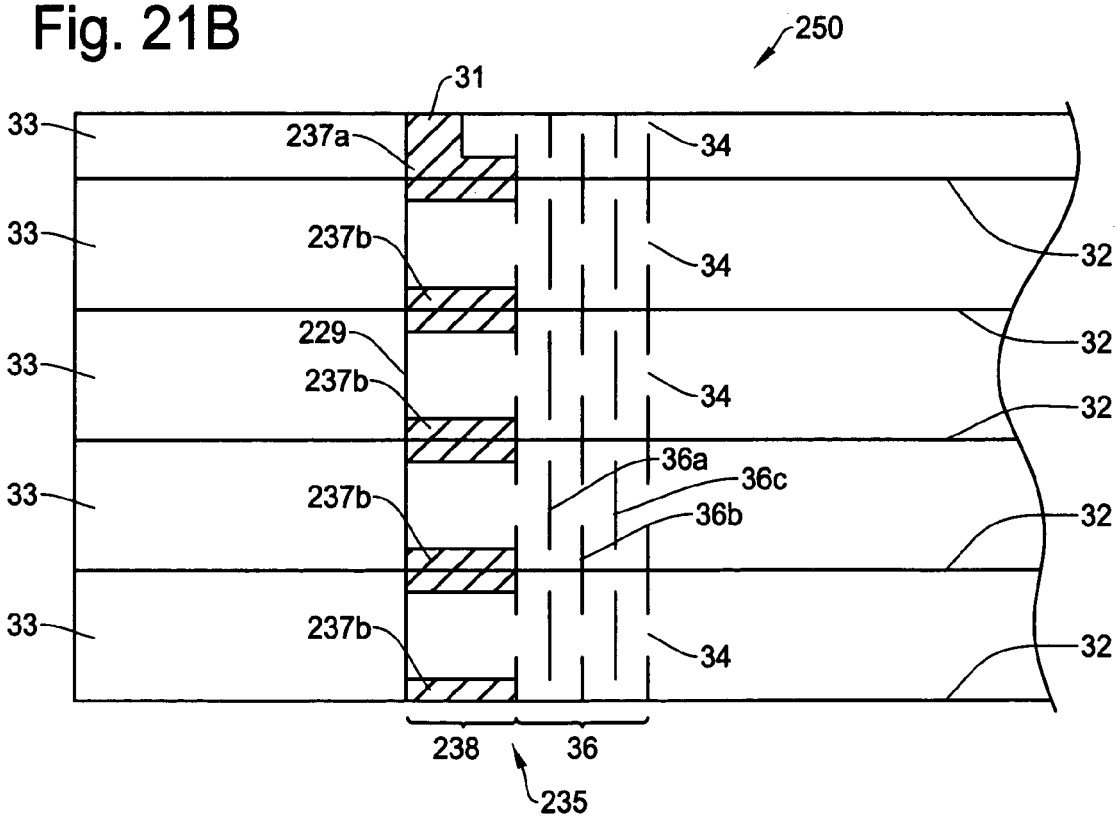

FIGS. 21A–21B are plan views showing examples of shape of the peeling agents for establishing the check valve of the present invention. FIG. 21A shows a case where a continuous peeling agent 137 of a belt like shape is formed on the check valve sheet. The width of the peeling agent 137 has to be selected so that the width is appropriate for the size of the air input 31 as well as sufficient for the air duct portion 138. The line 129 indicates the heat-sealing between the check valve film and one of the upper and lower films. This example is advantageous because it is unnecessary to accurately position the peeling agent 137 relative to the upper and lower films in the vertical direction of FIG. 21A.

FIG. 21B shows a case where a peeling agent 237*a* for the check valve having the air input 31 has an L-shape while other peeling agents 237*b* have a horizontal I-shape. The line 229 indicates the heat-sealing between the check valve film and one of the upper and lower films. The check valve film having the peeling agents 237*a*–237*b* has to be positioned accurately so that the L-shaped peeling agent 237*a* has to come to the edge of the upper and lower thermoplastic films. This example is advantageous because the material for the peeling agents can be minimized, which contributes to the reduction of the cost of the air-packing device.

As has been described above, according to the present invention, the check valves for an air-packing device can be produced with low cost and easily attached to any locations of the air-packing device. The check valve of the present invention allows to flow the air in two opposite directions of the air-packing device. Since the check valves can be attached to any locations on the air-packing device and allows the air flows in two opposite directions of the air-packing device, all of the air cells of the air-packing device can be inflated by air from an air compressor with a lower air pressure.

The check valve can be configured by a single check valve film attached to a thermoplastic film of the air-packing device. Alternatively, the check valve can be configured by two films juxtaposed with one another and attached to a thermoplastic film of the air-packing device. Peeling agents are printed on predetermined locations on the check valve film to produce an air input and a common air duct. Because of this simple structure, the check valves can be made easily with low cost.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. A structure of check valves for use in an air-packing device for protecting a product therein wherein the air-packing device has a plurality of air containers and is made of first and second thermoplastic films, comprising:

a check valve film on which peeling agents of predetermined pattern are applied, said check valve film being attached to one of the first and second thermoplastic films;

an air input established by one of the peeling agents on the air-packing device for receiving air from an air source;

an air flow maze portion forming an air passage of a zig-zag shape, said air flow maze portion having an exit at an end thereof for supplying the air from the air passage to a corresponding air container having one or more series connected air cells; and a common air duct portion which provides the air from the air input to the air flow maze portion of a current air container as well as to the air flow maze portion of a next air container having one or more series connected air cells;

wherein heat-sealing between the first and second thermoplastic films for air tightly separating two adjacent air containers is prevented in a range where said peeling agent is applied, and wherein said air passage in said air flow maze portion is created by heat-sealing the check valve film with one of the first and second thermoplastic films.

2. A structure of check valves as defined in claim 1, wherein an additional film for the check valve is provided between the check valve film and one of said first and second thermoplastic films.

3. A structure of check valves as defined in claim 1, wherein the check valve film is attached to one of said first and second thermoplastic films at any desired locations of the air-packing device.

4. A structure of check valves as defined in claim 1, wherein at least the air passage in said air flow maze portion is closed by air-tightly contacting the check valve film with one of said first and second thermoplastic films by the air pressure within the air cell when the air-packing device is filled with the compressed air to a sufficient degree.

5. A structure of check valves as defined in claim 2, wherein at least the air passage in said air flow maze portion is closed by air-tightly contacting the check valve film with said additional film by the air pressure within the air cell when the air-packing device is filled with the compressed air in a sufficient level.

6. A structure of check valves as defined in claim 1, wherein the pattern of said peeling agent on said check valve film has a narrow end and a broad end, and wherein said air input is an opening between the check valve film and one of said first and second thermoplastic films created by said narrow end of the peeling agent.

7. A structure of check valves as defined in claim 6, wherein the pattern of said peeling agent has an L-shape where said narrow end is on a vertical line of the L-shape and said broad end is on a horizontal line of the L-shape.

8. A structure of check valves as defined in claim 1, wherein the pattern of said peeling agent on said check valve film is a belt like shape extending from one side to another side of the air-packing device.

9. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established between the first and second thermoplastic films for the corresponding air containers, each of the check valves allowing the compressed air to flow in a predetermined direction of the check valve;

an air input formed on one of the check valves to supply the compressed air to all of the series connected air cells through the check valves; and heat-seal flanges that are made of thermoplastic film and are formed on side edges close to both ends of the air-packing device;

wherein said check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container; and wherein, through a post heat-seal treatment, predetermined points on said air containers are bonded with one another, and said heat-seal flanges are bonded with one another, thereby creating a container portion having an opening for packing a product therein and a cushion portion for supporting the container portion when the air-packing device is inflated by the compressed air.

10. An air-packing device as defined in claim 9, wherein said check valves are formed at any desired position on the air-packing device where the air from the check valve flows in both forward and backward directions in the air container to fill all of the series connected air cells therein.

11. An air-packing device as defined in claim 9, wherein said cushion portion has a triangular shape where the container portion is formed on a summit of the triangular shape of the cushion portion.

12. An air-packing device as defined in claim 9, wherein said cushion portion has a pentagon shape where the container portion is formed on a summit of the pentagon shape of the cushion portion.

13. An air-packing device as defined in claim 9, wherein said predetermined portions for bonding the first and second thermoplastic films include heat-seal lands each being formed at about a center of the air container to define said air cells, and wherein said heat-seal lands are folding points of the air-packing device when the air-packing device is inflated after the post heat-seal process.

14. An air-packing device as defined in claim 13, wherein, each of said heat-seal lands forms two air flow passages at both sides thereof in said air container thereby allowing the compressed air to flow to the series connected air cells through the two air passages.

15. An air-packing device as defined in claim 9, wherein said predetermined portions for bonding the first and second thermoplastic films include heat-seal lands each being formed on a bonding line which air-tightly separates two adjacent air containers to define said air cells, and wherein said heat-seal lands are folding points of the air-packing device when the air-packing device is inflated after the post heat-seal process.

16. An air-packing device as defined in claim 15, wherein, each of said heat-seal lands forms an air flow passage at about a center of the air container thereby allowing the compressed air to flow to the series connected air cells through the air passage.

17. An air-packing device as defined in claim 9, wherein, when packing a product to be protected in a container box, said cushion portion of the air-packing device contacts with an inner wall of the container box while the container portion of the air-packing device floatingly supports the product in the air without contacting with inner walls of the container box.

18. An air-packing device as defined in claim 17, wherein said cushion portion has a triangular shape where the container portion is formed on a summit of the triangular shape of the cushion portion, and the air cell forming a base of the triangular shape contacts with the inner walls of the container box.

19. An air-packing device as defined in claim 17, wherein said cushion portion has a pentagon shape where the container portion is formed on a summit of the pentagon shape of the cushion portion, and the air cells forming a base and sides of the pentagon shape contact with the inner walls of the container box.

20. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having a plurality of series connected air cells;

a plurality of check valves established between the first and second thermoplastic films for the corresponding air containers, each of the check valves allowing the compressed air to flow in a predetermined direction of the check valve;

an air input formed on one of the check valves to supply the compressed air to all of the series connected air cells through the check valves; and heat-seal flanges that are made of thermoplastic film and are formed on side edges close to both ends and intermediate positions of the air-packing device;

wherein said check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container; and wherein, through a post heat-seal treatment, predetermined points on said air containers are bonded with one another, and said heat-seal flanges are bonded with one another, thereby creating two container portions facing with one another each having an opening for packing a product therein and two cushion portions at opposite ends of the air-packing device for supporting the container portions when the air-packing device is inflated by the compressed air.

21. An air-packing device as defined in claim 20, wherein, when packing a product to be protected in a container box, said two cushion portions of the air-packing device contact with inner walls of the container box while the two container portions of the air-packing device floatingly support the product in the air without contacting with inner walls of the container box.

22. An air-packing device as defined in claim 21, wherein each of said two cushion portions has a triangular shape where the corresponding container portion is formed on a summit of the triangular shape of the cushion portion, and the air cell forming a base of the triangular shape of each of the cushion portion contacts with the corresponding inner wall of the container box.

23. An air-packing device as defined in claim 21, wherein each of said two cushion portions has a pentagon shape where the corresponding container portion is formed on a summit of the pentagon shape of the cushion portion, and the air cells forming a base and sides of the pentagon shape of each of the cushion portion contacts with the corresponding inner walls of the container box.

24. An air-packing device inflatable by compressed air for protecting a product therein, comprising:

first and second thermoplastic films superposed with each other where predetermined portions of the first and second thermoplastic films are bonded, thereby creating a plurality of air containers of different length, each of the air containers having a plurality of series connected air cells;

a plurality of check valves established between the first and second thermoplastic films for the corresponding air containers, each of the check valves allowing the compressed air to flow in a predetermined direction of the check valve;

an air input formed on one of the check valves to supply the compressed air to all of the series connected air cells through the check valves; and heat-seal edges made of thermoplastic film and formed on both ends of the air-packing device;

wherein said check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container; and wherein, through a post heat-seal treatment, predetermined points on said air containers are bonded with one another, and said heat-seal edges are bonded with one another, thereby creating an opening which is larger at a front side than that at a rear side for packing a product therein when the air-packing device is inflated by the compressed air.

25. An air-packing device as defined in claim 24, wherein, when packing a product to be protected in a container box, said opening of the air-packing device packs a corner of the product at each inner corner of the container box thereby securely holding the product in the container box.

26. An air-packing device inflatable by compressed air for protecting a product therein, comprising:

first and second thermoplastic films superposed with each other where predetermined portions of the first and second thermoplastic films are bonded, thereby creating a plurality of air containers, each of the air containers having one or more series connected air cells;

a plurality of check valves established between the first and second thermoplastic films for the corresponding air containers, each of the check valves allowing the compressed air to flow in a predetermined direction of the check valve;

an air input formed on one of the check valves to supply the compressed air to all of the air cells through the check valves; and a pair of strings each being formed on an end of the air-packing device;

wherein the product to be protected is wrapped around by the air-packing device and each end of the air-packing device is fastened by the string for securely holding the product therein before or after inflating the air-packing device; and wherein said check valve is configured by an air flow maze portion forming an air passage of a zig-zag shape for supplying the air to a corresponding air container having one or more series connected air cells, and a common air duct portion which provides the air to the air flow maze portion of a current air container as well as to the air flow maze portion of a next air container.

27. A method of producing an air-packing device having a plurality of air containers and a plurality of check valves, comprising the following steps of:

providing first and second thermoplastic films for forming the plurality of air containers:

attaching a check valve film to one of the first and second thermoplastic films, the check valve film being applied thereon predetermined patterns made of peeling agents;

forming an air input by one of the peeling agents on the air-packing device for receiving air from an air source;

forming an air flow maze portion having an air passage of a zig-zag shape for supplying the air to a corresponding air container having one or more series connected air cells;

forming a common air duct portion which provides the air from the air input to the air flow maze portion of a current air container as well as to the air flow maze portion of a next air container having one or more series connected air cells; and bonding the first and second thermoplastic films for air-tightly separating the air containers from one another.

28. A method of producing an air-packing device as defined in claim 27, further comprising a step of folding the air-packing device in a sheet form and a step of heat-sealing predetermined portions to create a container portion having an opening for packing a product to be protected when inflating the air-packing device.

29. A method of producing an air-packing device as defined in claim 27, wherein said step of bonding the first and second thermoplastic films for separating the air containers includes a step of preventing the bonding between the first and second thermoplastic films at a range where the peeling agent is applied.

30. A method of producing an air-packing device as defined in claim 27, wherein said step of forming the air flow maze portion includes a step of bonding the check valve film and one of said first and second thermoplastic films at two or more lines thereby forming the air passage of zig-zag shape.

* * * * *